US010508454B2

(12) United States Patent
Suzuki

(10) Patent No.: US 10,508,454 B2
(45) Date of Patent: Dec. 17, 2019

(54) EXTERIOR-MATERIAL SECURING MEMBER AND BUILDING EXTERIOR STRUCTURE

(71) Applicant: Nichiha Corporation, Nagoya-shi, Aichi (JP)

(72) Inventor: Kenji Suzuki, Nagoya (JP)

(73) Assignee: NICHIHA CORPORATION, Nagoya-Shi (JP)

( * ) Notice: Subject to any disclaimer, the term of this patent is extended or adjusted under 35 U.S.C. 154(b) by 0 days.

(21) Appl. No.: 15/625,502

(22) Filed: Jun. 16, 2017

(65) Prior Publication Data

US 2018/0016797 A1 Jan. 18, 2018

(30) Foreign Application Priority Data

Jul. 12, 2016 (JP) ..... 2016-137748

(51) Int. Cl.
*E04F 13/08* (2006.01)
*E04B 1/41* (2006.01)
*E04B 1/38* (2006.01)

(52) U.S. Cl.
CPC ..... *E04F 13/0846* (2013.01); *E04B 1/40* (2013.01); *E04B 2001/405* (2013.01)

(58) Field of Classification Search
CPC ..... E04F 13/0846; E04F 13/0828; E04F 13/0801; E04F 13/0826; E04B 1/40; Y10T 403/7094
See application file for complete search history.

(56) References Cited

U.S. PATENT DOCUMENTS 6,279,286 B1 * 8/2001 Ichihashi ..... E04F 13/0826 248/218.4
6,315,489 B1 * 11/2001 Watanabe ..... E04F 13/0846 248/220.21

(Continued)

FOREIGN PATENT DOCUMENTS

AU 2009100527 A4 7/2009
EP 0791700 A1 8/1997

(Continued)

OTHER PUBLICATIONS

European Patent Office Communication and extended search report issued in the corresponding European Patent Application No. 17174912.0 dated Dec. 21, 2017.

(Continued)

*Primary Examiner* — Brian E Glessner
*Assistant Examiner* — Daniel J Kenny
(74) *Attorney, Agent, or Firm* — Birch, Stewart, Kolasch & Birch, LLP

(57) ABSTRACT

A securing member includes a fixing portion that is fixed to a framework; a supporting portion that projects from the fixing portion and supports an exterior material; a first engagement portion that is disposed on the supporting portion so as to extend in a first direction and engages with the exterior material; a second engagement portion that is disposed on the supporting portion so as to extend in a second direction, which is opposite to the first direction, and engages with the exterior material; a first contact portion that is disposed in the first direction from the supporting portion and contacts a back surface of the exterior material; and a second contact portion that is disposed in the second direction from the supporting portion and contacts the back surface of the exterior material. The second contact portion (Continued)

is formed in a folded portion that is folded toward the supporting portion.

11 Claims, 21 Drawing Sheets

(56) References Cited

U.S. PATENT DOCUMENTS

| | | | | |
|---|---|---|---|---|
| 2001/0045075 | A1* | 11/2001 | Watanabe | E04F 13/0826 52/712 |
| 2002/0095889 | A1 | 6/2002 | Hikai | |
| 2005/0102944 | A1* | 5/2005 | Hikai | E04F 13/0846 52/511 |
| 2010/0122506 | A1* | 5/2010 | Kato | E04F 13/0846 52/483.1 |

FOREIGN PATENT DOCUMENTS

| | | | |
|---|---|---|---|
| EP | 2447440 | A1 | 5/2012 |
| JP | 10-2089 | A | 1/1998 |
| JP | 10-148024 | A | 6/1998 |
| JP | 2000-87529 | A | 3/2000 |
| JP | 3438723 | B2 | 8/2003 |
| JP | 2005-232710 | A | 9/2005 |
| JP | 2006-265864 | A | 10/2006 |
| TW | M371763 | U1 | 1/2010 |

OTHER PUBLICATIONS

Taiwanese Search Report, dated Sep. 21, 2018, for Taiwanese Application No. 106119117.

* cited by examiner

EXTERIOR-MATERIAL SECURING MEMBER AND BUILDING EXTERIOR STRUCTURE

CROSS REFERENCES TO RELATED APPLICATIONS

This application is based on Japanese Patent Application No. 2016-137748 filed in the Japanese Patent Office on Jul. 12, 2016, the entire contents of which are hereby incorporated by reference.

BACKGROUND OF THE INVENTION

1. Field of the Invention

The present invention relates to an exterior-material securing member and a building exterior structure.

2. Description of the Related Art

Examples of existing exterior-material securing members are disclosed in Japanese Unexamined Patent Application Publication No. 2006-265864 (Patent Document 1), Japanese Unexamined Patent Application Publication No. 2005-232710 (Patent Document 2), Japanese Unexamined Patent Application Publication No. 10-148024 (Patent Document 3), and Japanese Unexamined Patent Application Publication No. 2000-87529 (Patent Document 4). Each securing member includes a fixing portion that is fixed to a framework and a supporting portion that supports an exterior material.

Each securing member includes a first engagement portion that is disposed on the supporting portion so as to extend upward and engages with the exterior material, and a second engagement portion that is disposed on the supporting portion so as to extend downward and engages with the exterior material.

Each securing member further includes a first contact portion that is disposed above the supporting portion and contacts a back surface of the exterior material, and a second contact portion that is disposed below the supporting portion and contacts the back surface of the exterior material.

To be specific, in the securing member disclosed in Patent Document 1, the supporting portion and the first and second engagement portions are formed by cutting and raising a part of the fixing portion, and an opening is formed below the supporting portion.

In the securing member disclosed in Patent Document 2, the supporting portion and the first and second engagement portions are formed by bending a lower end portion of the fixing portion. The first contact portion is formed above the supporting portion of the fixing portion. The second contact portion is formed by bending downward a small part of the fixing portion located directly above the supporting portion.

In the securing member disclosed in Patent Document 3, as shown in FIG. 1 and other figures in Patent Document 3, the supporting portion is formed by bending the fixing portion at two positions (an upper position and a lower position) so that two steel plates overlap. The first engagement portion is formed in an upper one of the two steel plates of the supporting portion. The second engagement portion is formed in a lower one of the two steel plates of the supporting portion. The first and second contact portions are respectively formed in the upper steel plate and the lower steel plate, which are two steel plates of the supporting portion, or in only one of the two steel plates of the supporting portion.

In the securing member disclosed in Patent Document 4, the supporting portion, the first and second engagement portions, and the first and second contact portions are formed in a folded portion that is bent upward in a U-shape from a lower part of the fixing portion.

However, in the securing member disclosed in Patent Document 1, the second contact portion is formed below the supporting portion and below the opening. Therefore, the securing member may not be able to stably support an exterior material. Therefore, to stably support the exterior material, it is necessary to use additional means, such as integrating a contact portion of a side surface of the opening with the second contact portion, which is formed below the opening.

In the securing member disclosed in Patent Document 2, the second contact portion is small, and therefore the second contact portion contacts only a small area of the back surface of the exterior material. As a result, the securing member may not be able to stably support an exterior material. Therefore, to stably support the exterior material, it is necessary use additional means, such as adjusting the thickness of the securing member from a reference surface of the securing member to the second contact portion.

In the securing member disclosed in Patent Document 3, two steel plates of the support portion may become deformed so as to be displaced from each other due to, for example, a load or the like that is generated when the supporting portion supports the exterior material. As a result, the first and second engagement portions may become displaced from each other. When the exterior material is engaged with the first and second engagement portions that have been displaced from each other, breakage or unevenness of end portions of the exterior material occurs easily, and the securing member may not be able to stably support the exterior material. Moreover, in the securing member, the thickness of the supporting portion is the sum of the thicknesses of the two steel plates and the width of the gap between the steel plates. Therefore, the distance between exterior materials that are adjacent to each other with the supporting portion therebetween increases, and trouble, such as entry of rainwater, becomes more likely to occur.

In the securing member disclosed in Patent Document 4, the supporting portion, the first and second engagement portions, and the first and second contact portions are formed in the U-shaped bent portion. Therefore, it is difficult for the entirety of the securing member to have a sufficient strength. Therefore, the securing member may deform easily and may not be able to stably support the exterior material.

SUMMARY OF THE INVENTION

The present invention, which has been devised against the background described above, provides an exterior-material securing member and a building exterior structure that can stably support an exterior material by preventing deformation of the securing member and can reduce trouble of entry of rainwater from a gap between exterior materials.

According to a first aspect of the present invention, an exterior-material securing member, which is a securing member for securing an exterior material to a framework of a building, includes a fixing portion that is fixed to the framework; a supporting portion that projects from the fixing portion and supports the exterior material; a first engagement portion that is disposed on the supporting portion so as to extend in a first direction and engages with the exterior material; a second engagement portion that is disposed on the supporting portion so as to extend in a second direction, which is opposite to the first direction, and engages with the exterior material; a first contact portion that is disposed in the first direction from the supporting portion and contacts a back surface of the exterior material; and a second contact portion that is disposed in the second direction from the supporting portion and contacts the back surface of the exterior material. The second contact portion is formed in a folded portion that is folded toward the supporting portion.

In the exterior-material securing member according to the first aspect, the supporting portion projects from the fixing portion, and the first and second engagement portions are disposed on the supporting portion. The second contact portion is formed in the folded portion that is folded toward the supporting portion. Therefore, with the securing member, the degree of freedom in positioning the second contact portion is increased. As a result, the second contact portion can be easily disposed near the supporting portion. As necessary, the second contact portion may be disposed on the center line of the securing member.

With the securing member, the size of the folded portion can be easily increased. Therefore, the size of the second contact portion can also be increased. Moreover, with the securing member, the folded portion can reinforce a region around a part of the fixing portion adjacent to the folded portion. Therefore, the entirety of the securing member can easily have a sufficient strength.

As a result, the exterior-material securing member according to the first aspect of the present invention can stably support the exterior material by preventing deformation thereof and can reduce trouble of entry of rainwater from a gap between the exterior materials.

According to a second aspect of the present invention, preferably, an end portion of the second contact portion located in the first direction is disposed at a position where the end portion is in contact with the supporting portion or at a position where the end portion is capable of contacting the supporting portion when the supporting portion bends.

In this case, the second contact portion of the folded portion can support the supporting portion. As a result, it is possible to effectively reduce deformation of the supporting portion due to a load or the like that is generated when the securing member supports the exterior material.

According to a third aspect of the present invention, preferably, the folded portion is folded in the first direction from an end portion of the fixing portion located in the second direction.

In this case, compared with a case where the folded portion is folded in a direction perpendicular to the first and second directions, the folded portion and the second contact portion can be easily formed. Moreover, the second contact portion can be easily disposed on the center line of the securing member. As a result, the securing member can more stably support the exterior material.

According to a fourth aspect of the present invention, preferably, the exterior-material securing member further includes a bulging portion that is disposed in the first direction from the supporting portion and bulges from the fixing portion. In addition, preferably, the first contact portion includes a first surface that is formed by a front end surface of the bulging portion.

In this case, the bulging portion can increase the strength of the first surface and the strength of the entirety of the securing member. Moreover, the first surface can be easily disposed on the center line of the securing member. As a result, the securing member can more stably support the exterior material.

According to a fifth aspect of the present invention, preferably, the exterior-material securing member further includes a pair of side plate portions that are respectively formed by bending an end portion of the fixing portion located in a third direction, which is substantially perpendicular to the first direction, and an end portion of the fixing portion located in a fourth direction, which is opposite to the third direction.

In this case, the pair of side plate portions, which are bent, can reinforce the fixing portion. Therefore, the entirety of the securing member can more easily have a sufficient strength. Moreover, because the pair of side plate portions are disposed on both sides of the fixing portion and cover the end surfaces of the fixing portion, the appearance of the securing member is improved.

According to a sixth aspect of the present invention, preferably, the first contact portion includes second surfaces that are formed by front edges of the pair of side plate portions.

In this case, the second surfaces are formed by using the thicknesses of the side plate portions, which are bent from the fixing portion, and can be used as a part of the first contact portion.

According to a seventh aspect of the present invention, preferably, the first contact portion includes third surfaces that are formed by bending front end portions of the pair of side plate portions in the third direction or in the fourth direction.

In this case, the third surfaces, whose areas are larger than those of the second surfaces and which are formed by using the thicknesses of the side plate portions, are formed by bending the front end portions of the side plate portions; and the third surfaces can be used as a part of the first contact portion.

According to an eighth aspect of the present invention, preferably, front end portions of the pair of side plate portions extend in a direction such that the front end portions support the second contact portion at positions in the second direction from the second contact portion.

In this case, the front end portions of the pair of side plate portions, which extend in a direction such that the front end portions support the second contact portion at positions in the second direction from the second contact portion, can support the second contact portion, and deformation of the second contact portion can be reduced. As a result, the exterior material can be stably supported.

According to a ninth aspect of the present invention, preferably, the exterior-material securing member further includes an erected portion that is formed on at least one of the second contact portion and a portion located in the second direction from the second contact portion and that is disposed between opposing end portions of two exterior materials that are adjacent to each other.

In this case, the erected portion can prevent displacement of the exterior material. Moreover, because the degree of freedom in positioning the erected portion is increased, the erected portion can be easily disposed near the supporting portion.

According to a tenth aspect of the present invention, a building exterior structure includes an exterior material, a framework of a building, and a securing member for securing the exterior material to the framework. The securing member includes a fixing portion that is fixed to the framework; a supporting portion that projects from the fixing portion and supports the exterior material; a first engagement portion that is disposed on the supporting portion so as to extend in a first direction and engages with the exterior material; a second engagement portion that is disposed on the supporting portion so as to extend in a second direction, which is opposite to the first direction, and engages with the exterior material; a first contact portion that is disposed in the first direction from the supporting portion and contacts a back surface of the exterior material; and a second contact portion that is disposed in the second direction from the supporting portion and contacts the back surface of the exterior material. The second contact portion is formed in a folded portion that is folded toward the supporting portion.

With the building exterior structure according to the tenth aspect of the present invention, due to the advantages effects of the securing member according to the first aspect, the exterior material can be stably supported by preventing deformation of the securing member, and trouble of entry of rainwater from a gap between exterior materials can be reduced.

With the exterior-material securing member and the building exterior structure according to the present invention, the exterior material can be stably supported by preventing deformation of the securing member, and entry of rainwater from a gap between exterior materials can be reduced.

DESCRIPTION OF THE PREFERRED EMBODIMENTS

Figure 1:
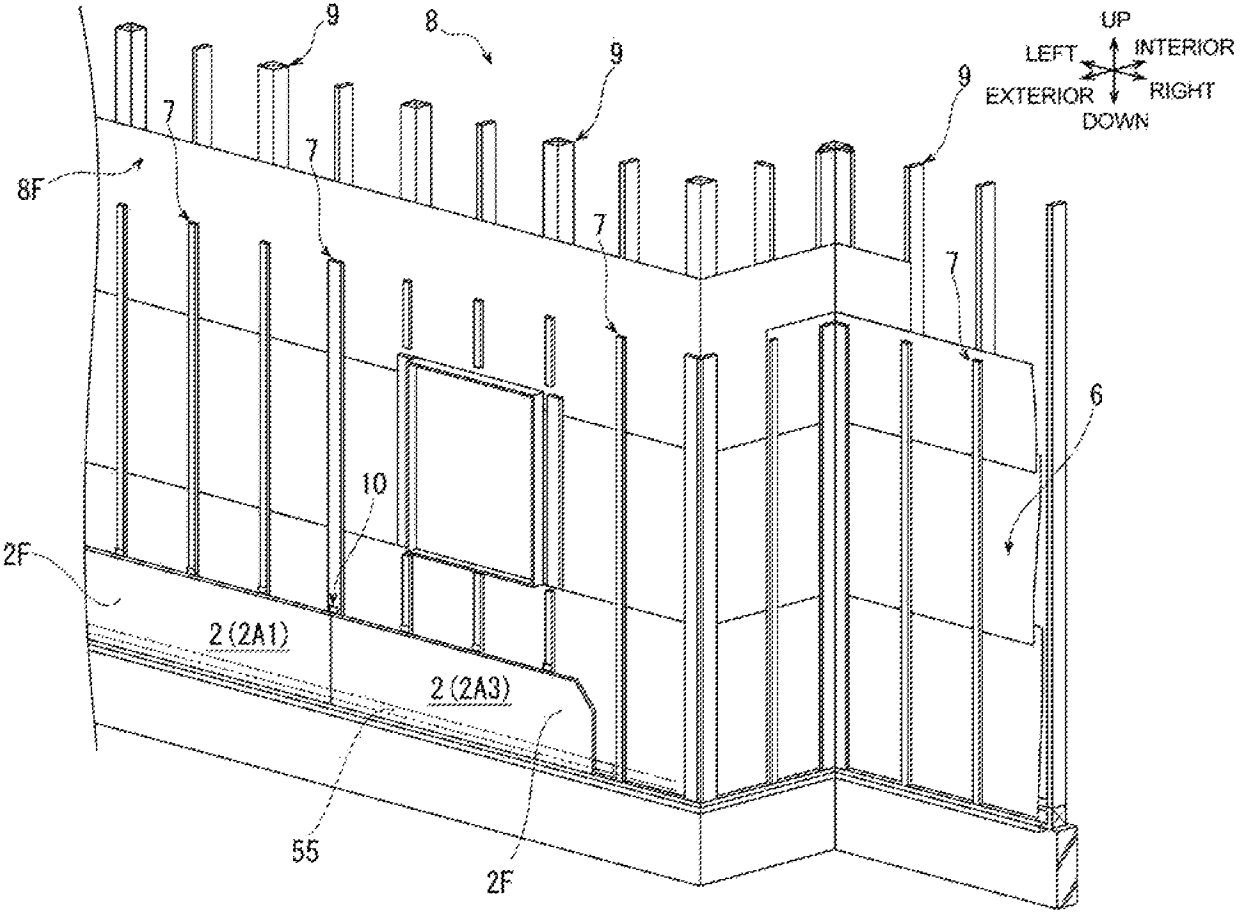
FIG. 1 is a perspective view of a building exterior structure according to a first embodiment.

Hereinafter, first to fifth embodiments of the present invention will be described below with reference to the drawings. In FIG. 1, "UP" denotes the vertically upward direction, and "DOWN" denotes the vertically downward direction. In addition, in FIG. 1, "LEFT" and "RIGHT" respectively denote the horizontally leftward and rightward directions when viewed in the direction from the exterior side to the interior side. The directions in FIG. 2 and other figures correspond to those in FIG. 1.

First Embodiment

FIG. 1 illustrates an exterior structure according to a first embodiment. The exterior structure includes a wooden framework 8 of a building, such as a house, a facility, or a warehouse; and a plurality of exterior wall plates 2 (shown in FIGS. 2 to 4 and other figures) secured to the wooden framework 8. The exterior wall plates 2 are examples of "exterior material". The exterior wall plates 2 are plate materials that have high strength and rigidity and constitute an exterior wall of a building. The exterior materials are not limited to the exterior wall plates. Alternatively, the exterior materials may be, for example, decorative boards having a designed surface.

Referring to FIG. 1, in the present embodiment, the framework 8 is constructed by timber framing. The framework 8 is composed of a plurality of structural members. The structural members include a plurality of columns 9 that are arranged with predetermined intervals therebetween in the horizontal direction and auxiliary members, such as studs disposed between the columns 9. Support members 7, which are called as furring strips, are fixed to the outer surfaces of the columns 9 that face the exterior side with fastening screws or nails (not shown). The support members 7 are also included in the structural members. A waterproof sheet 6 is disposed between the columns 9 and the support members 7. The structure of the framework 8 is not limited to that in the present embodiment. Alternatively, the framework 8 may be constructed by, for example, framing. The framework of the exterior structure may be made of, for example, steel, reinforced concrete, or brick.

Figure 4:
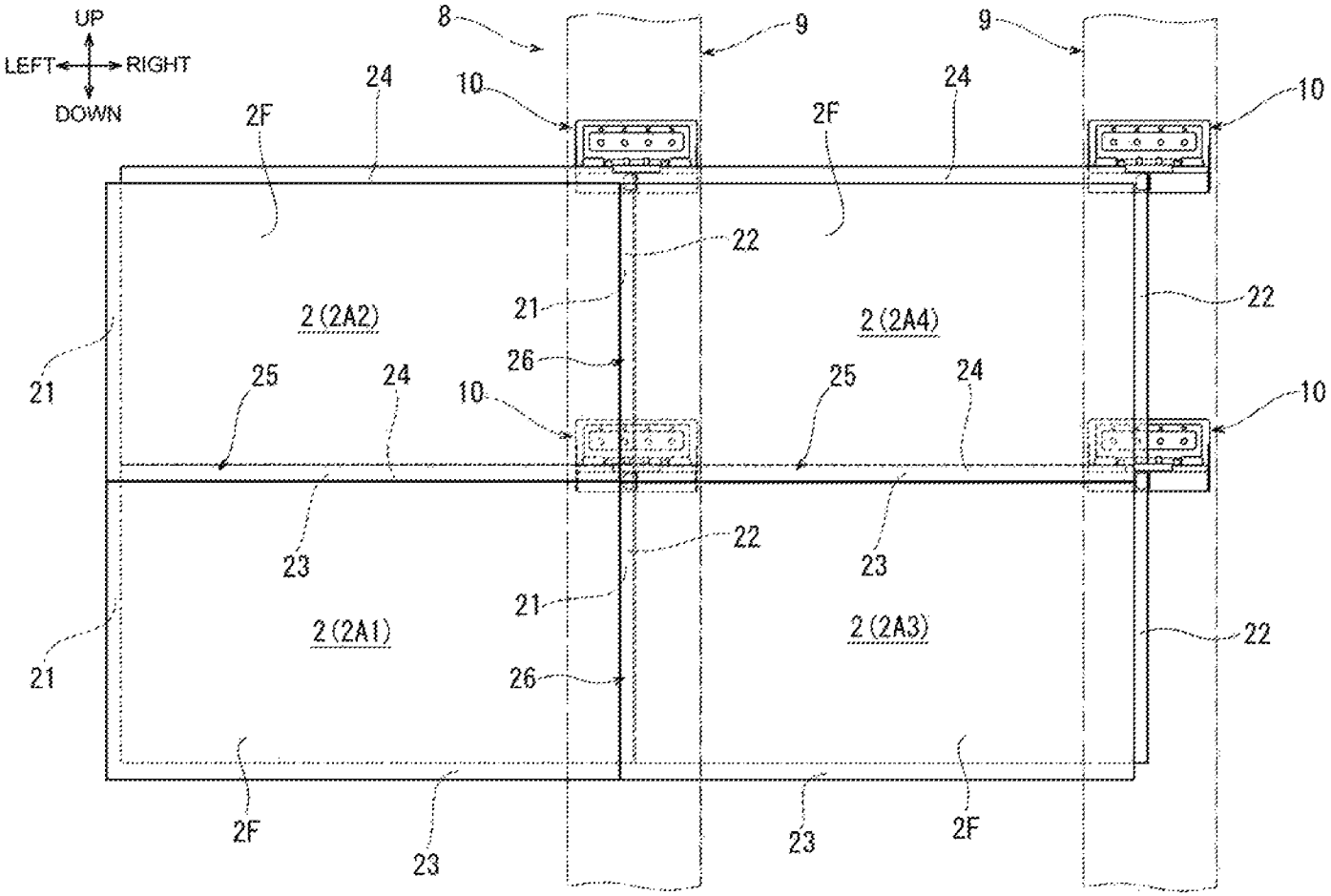
FIG. 4 is a front view illustrating the positional relationship between first to fourth exterior wall plates and securing members according to the first embodiment.

Referring to FIG. 4, a plurality of securing members 10 are fixed to the columns 9, which are structural members, so that the exterior wall plates 2 are secured to the framework 8 so as to be horizontally and vertically adjacent to each other. The securing members 10 are vertically arranged along each column 9.

Referring to FIGS. 5 to 12, each of the securing members 10 is formed by punching, pressing, and bending a metal plate, such a steel plate or a stainless steel plate. The material and the method of manufacturing the securing member 10 are not limited to these, and various materials and methods may be used as appropriate.

Referring to FIGS. 13 to 17, the securing member 10 is fixed to each column 9 with screws 10B. However, this is not a limitation. Alternatively, the securing member 10 may be fixed to, for example, the column 9 using other fasteners, such as nails, or may be fixed indirectly to the column 9 via the support member 7 (shown in FIG. 1) or the like.

Figure 14:
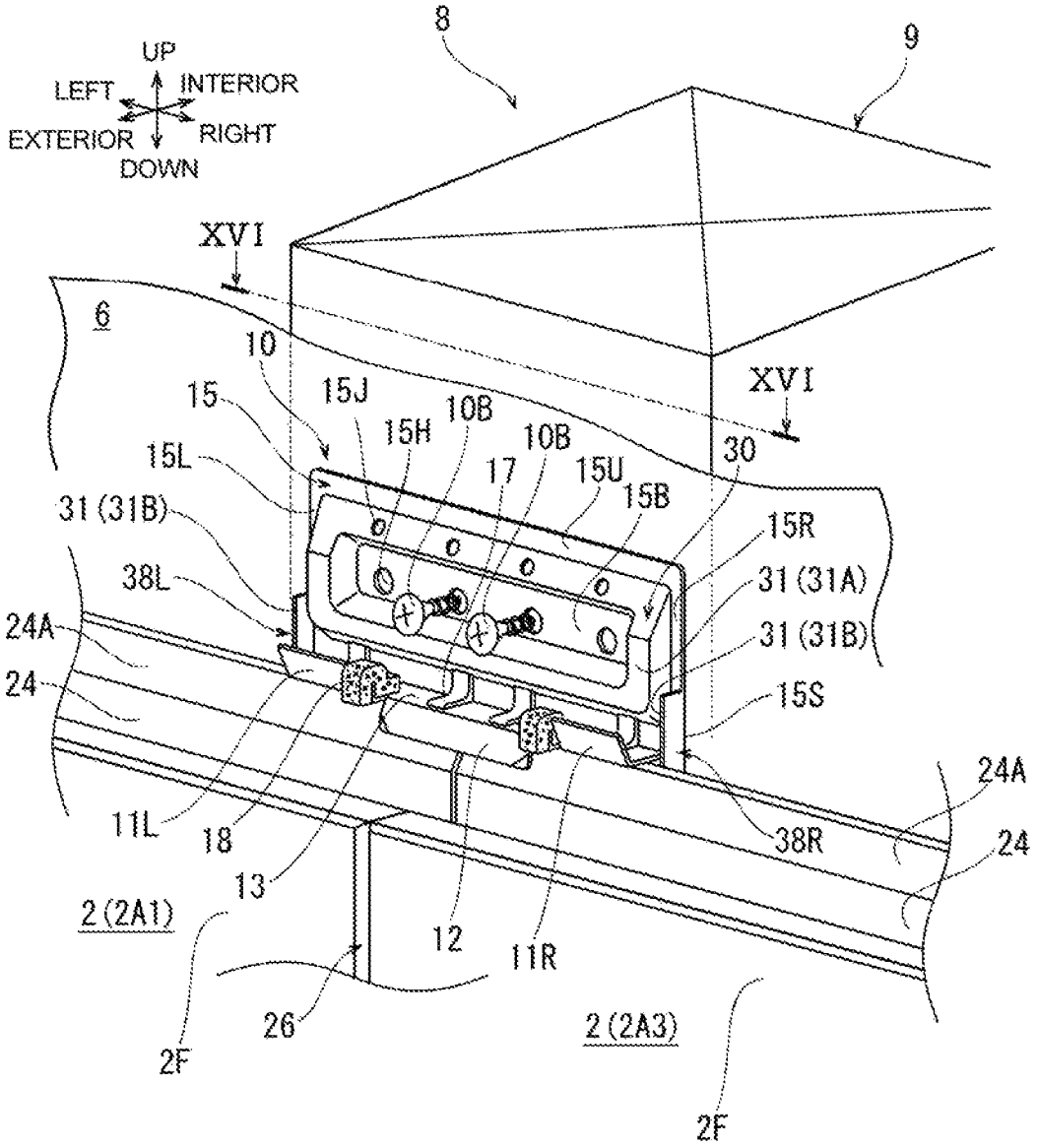
FIG. 14 is a partial perspective view illustrating the structure in which the first and third exterior wall plates are secured by using the securing member according to the first embodiment.

Referring to FIGS. 4, 14, and other figures, the standard orientation of the securing member 10 is the orientation in a fixed state in which a fixing portion 15 of the securing member 10 is fixed to the column 9. To be specific, the front side of the securing member 10 faces the exterior side, and the back side of the securing member 10 faces the interior side. The width direction of the securing member 10 is the horizontal direction. In the present embodiment, a first direction is the upward direction. A second direction, which is opposite to the first direction, is the downward direction. A third direction, which is substantially perpendicular to the first direction, is the leftward direction. A fourth direction, which is opposite to the third direction, is the rightward direction.

Referring to FIGS. 5 to 11, the securing member 10 includes the fixing portion 15, a bulging portion 30, a supporting portion 13, first engagement portions 11L and 11R, a second engagement portion 12, a folded portion 40, a pair of side plate portions 38L and 38R, a first contact portion 31, a second contact portion 42, and an erected portion 49.

Figure 12:
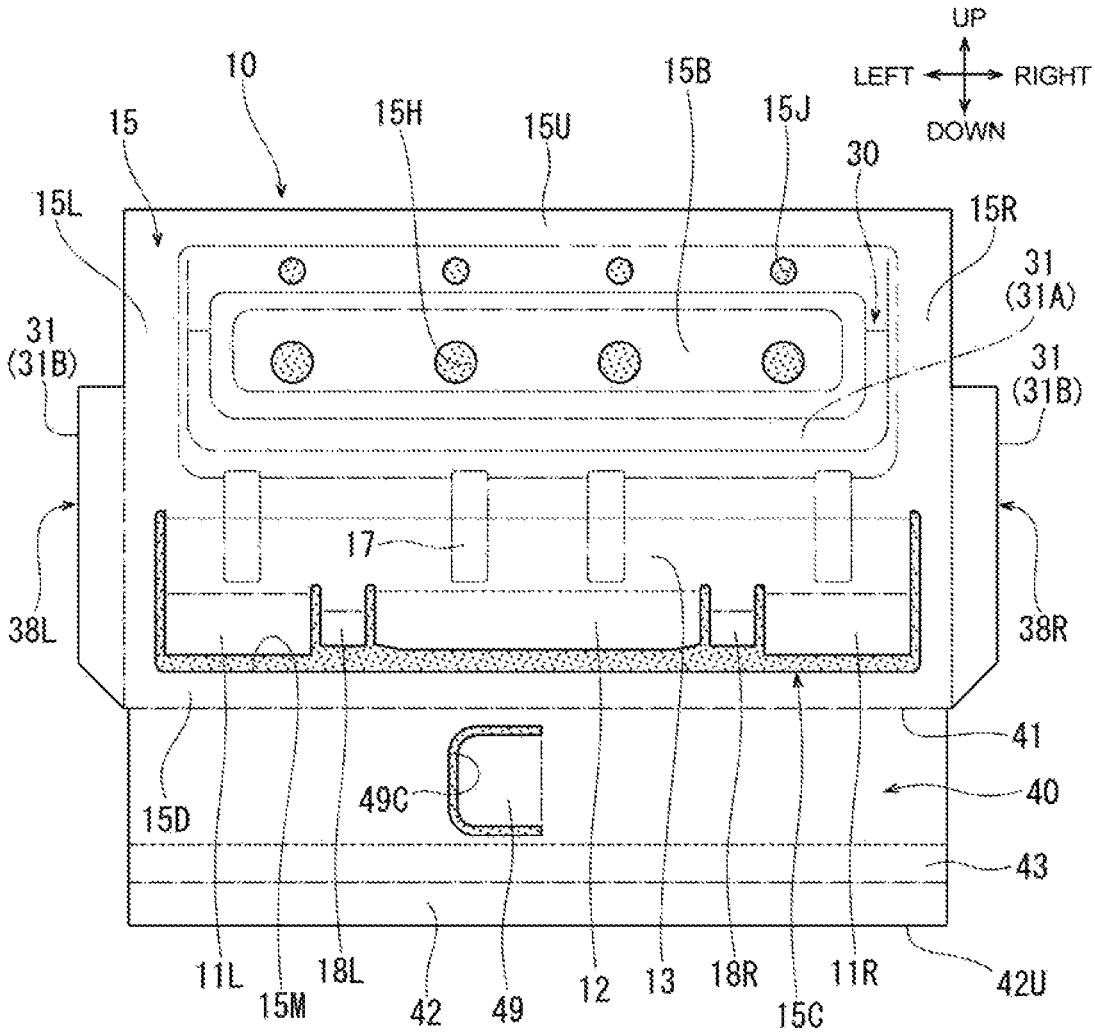
FIG. 12 is a developed view of a steel plate before being formed into the securing member according to the first embodiment.

FIG. 12 shows the shape of a steel plate, which is the material of the securing member 10, before being pressed, bent, and machined in other ways. The broken lines show positions where the steel plate is to be mountain-folded. The one-dot chain lines show portions where the steel plate is to be valley-folded. The two-dot chain lines show regions that will bulge when the steel plate is pressed.

Referring to FIGS. 5 to 11, the fixing portion 15 is a flat plate-like portion that surrounds the bulging portion 30, which is formed by pressing a metal plate, and an opening 15M, which is formed at a position below the bulging portion 30 as shown in FIG. 12 (developed view). The opening 15M is formed by bending a part of the steel plate inside a substantially U-shaped cutout portion 15C (shown in FIG. 12) toward the front side. As shown by a broken line in FIG. 6, the opening 15M has a substantially rectangular shape.

Figure 8:
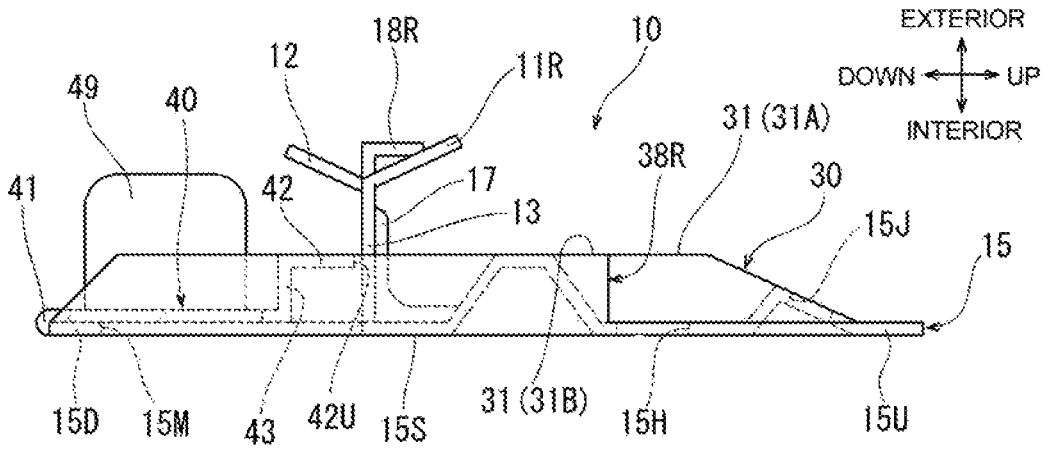
FIG. 8 is a side view of the securing member according to the first embodiment.

An upper end portion 15U, a lower end portion 15D, a left end portion 15L, and a right end portion 15R of the fixing portion 15 form a peripheral edge portion. The peripheral edge portion has a substantially rectangular loop-like shape that is symmetrical about a center line C1 extending in the vertical direction at the center of the securing member 10 in the width direction. Referring to FIG. 8 and other figures, a surface of the securing member 10 that contacts the column 9 or the like and that faces the back side is a reference surface 15S of the fixing portion 15.

Referring to FIGS. 5 to 11, the bulging portion 30 bulges from the fixing portion 15 toward the front side in a substantially rectangular loop shape. A surrounded portion 15B, which is surrounded by the bulging portion 30, is also a part of the fixing portion 15. A plurality of fixing holes 15H, which are arranged in the horizontal direction, extend through the surrounded portion 15B. The screws 10B are inserted into the fixing holes 15H to fix the securing member 10 to the column 9 or the like. A plurality of fixing holes 15J, which are arranged in the horizontal direction, extend through an inclined surface at an upper side of the bulging portion 30. The fixing holes 15J have a diameter smaller than that of the fixing holes 15H. Fasteners, such as screws or nails, for fixing the securing member 10 to the column 9 or the like, are inserted into the fixing holes 15J.

A front end surface of the bulging portion 30 at a lower side, a left side, and a right side of the bulging portion 30 forms a first surface 31A that extends parallel to the reference surface 15S of the fixing portion 15. The first surface 31A is a part of the first contact portion 31.

The supporting portion 13 is formed by bending a plate-like portion that is located inside the cutout portion 15C shown in FIG. 12. Referring to FIGS. 5 to 11, the supporting portion 13 projects toward the front side from a position that is adjacent to an upper side of the opening 15M of the fixing portion 15 and that is below the bulging portion 30, and the supporting portion 13 extends in the horizontal direction.

Referring to FIGS. 5 to 9, the first engagement portions 11L and 11R are respectively connected to a left part and a right part of the front edge of the supporting portion 13 and are bent upward. Referring to FIGS. 5 to 8 and 10, the second engagement portion 12 is connected to a central part of the front edge of the supporting portion 13 and is bent downward.

Referring to FIGS. 5 to 11, a plurality of projections 17, which are arranged in the horizontal direction, are formed on the supporting portion 13. Each projection 17 is a projection that projects upward from the supporting portion 13 and that has a substantially trapezoidal shape.

Holding portions 18L and 18R are disposed on the supporting portion 13. The left holding portion 18L is a small portion that is bent upward between the left first engagement portion 11L and the second engagement portion 12. The right holding portion 18R is a small portion that is bent upward between the right first engagement portion 11R and the second engagement portion 12.

Figure 5:
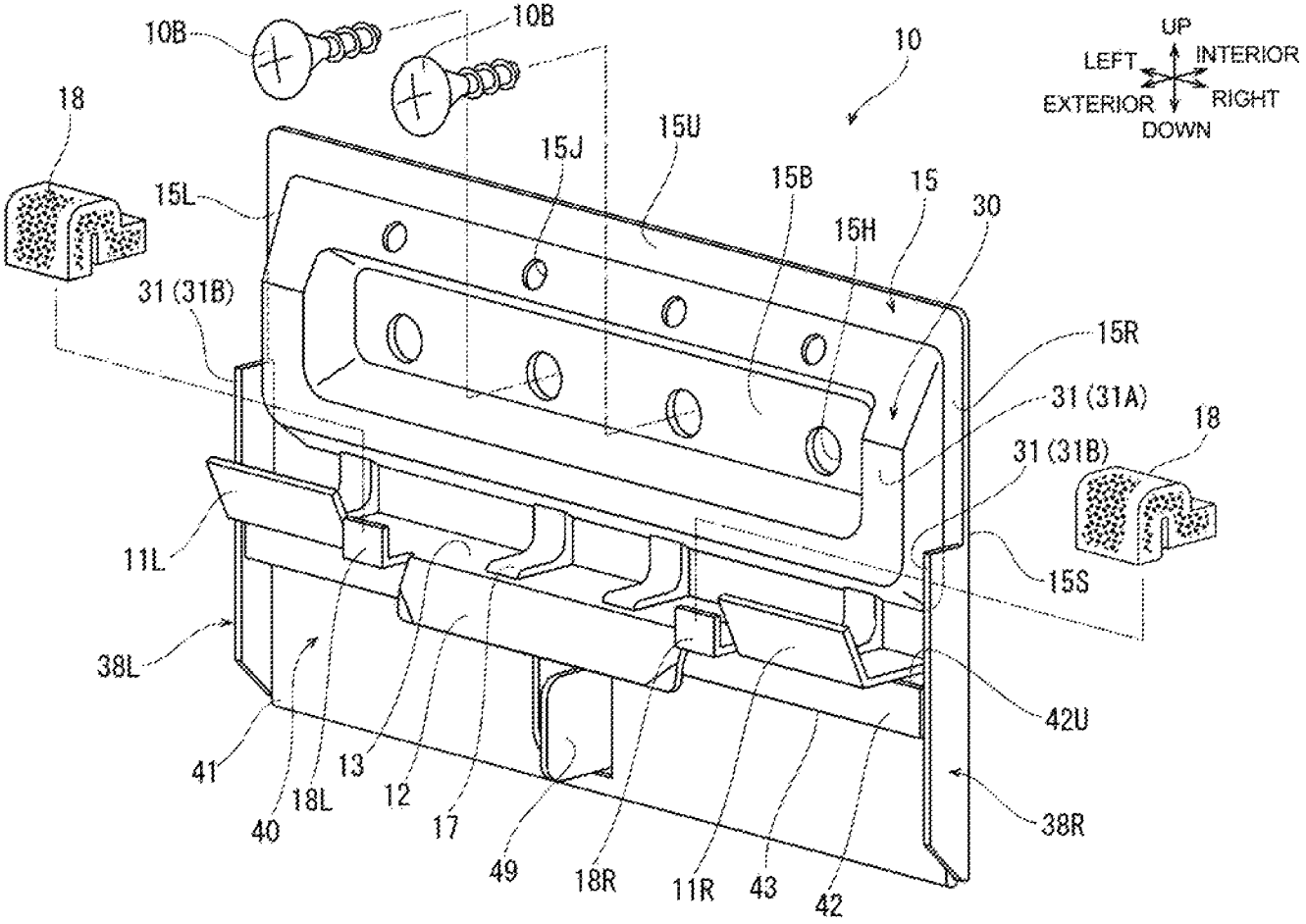
FIG. 5 is a perspective view of the securing member according to the first embodiment.
Figure 11:
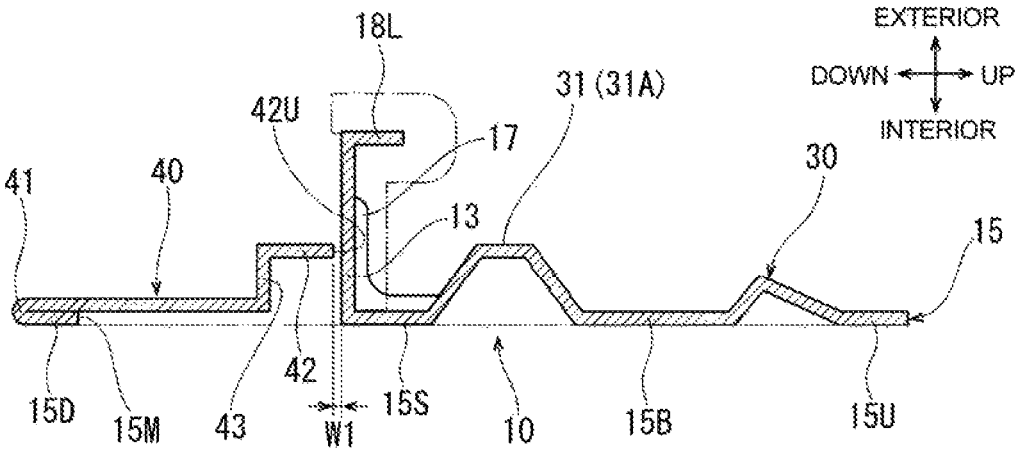
FIG. 11 is a sectional view taken along XI-XI in FIG. 7.

Referring to FIGS. 5 and 11, elastic members 18 are attached to the holding portions 18L and 18R using double-sided adhesive tapes or the like. Referring to FIG. 11, the elastic members 18 respectively cover the holding portions 18L and 18R and parts of the surface of the supporting portion 13 facing upward, and the elastic members 18 are in contact with the fixing portion 15. Alternatively, the elastic members 18 may be omitted.

The folded portion 40 includes a bent portion 41. Referring to FIG. 12 (developed view), a substantially rectangular plate-like portion, which is to become the folded portion 40, is connected to the lower end portion 15D of the fixing portion 15. The bent portion 41 is a substantially U-shaped bent portion that is formed by folding the substantially rectangular plate-like portion upward from the lower end portion of 15D of the fixing portion 15.

The folded portion 40 extends upward from the bent portion 41 so as to become closer to the supporting portion 13 and extends in the horizontal direction.

Figure 6:
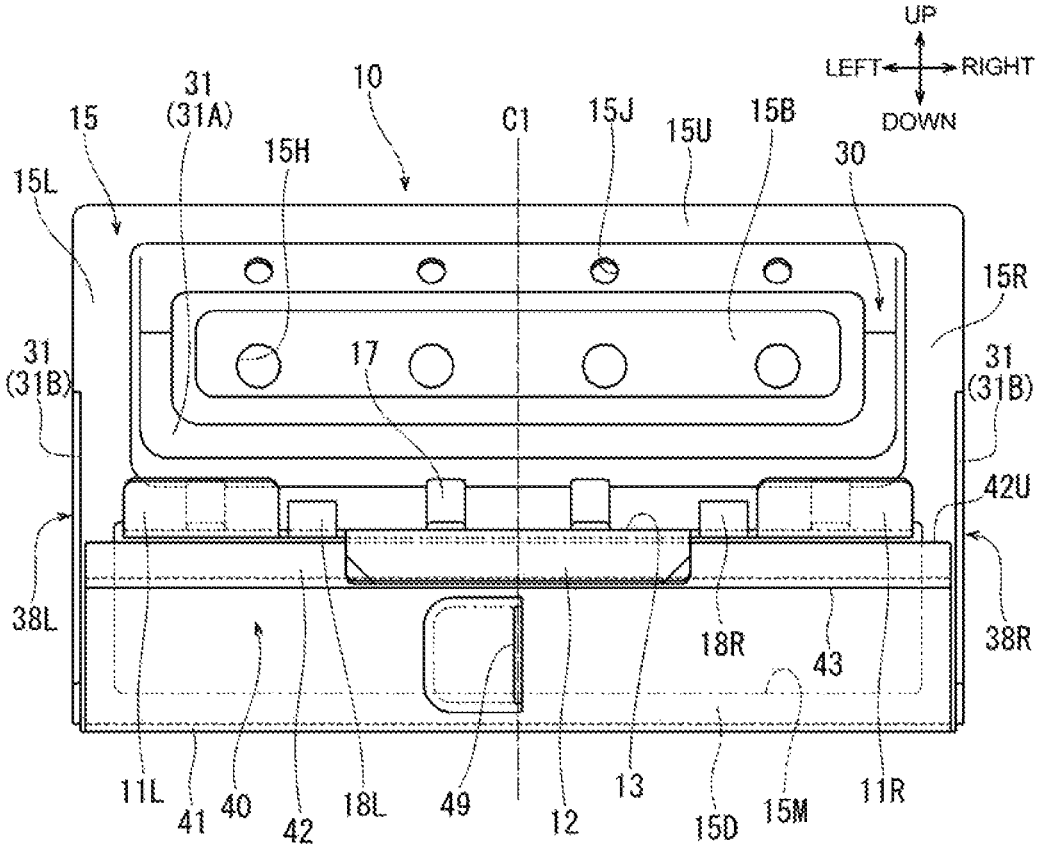
FIG. 6 is a front view of the securing member according to the first embodiment.
Figure 7:
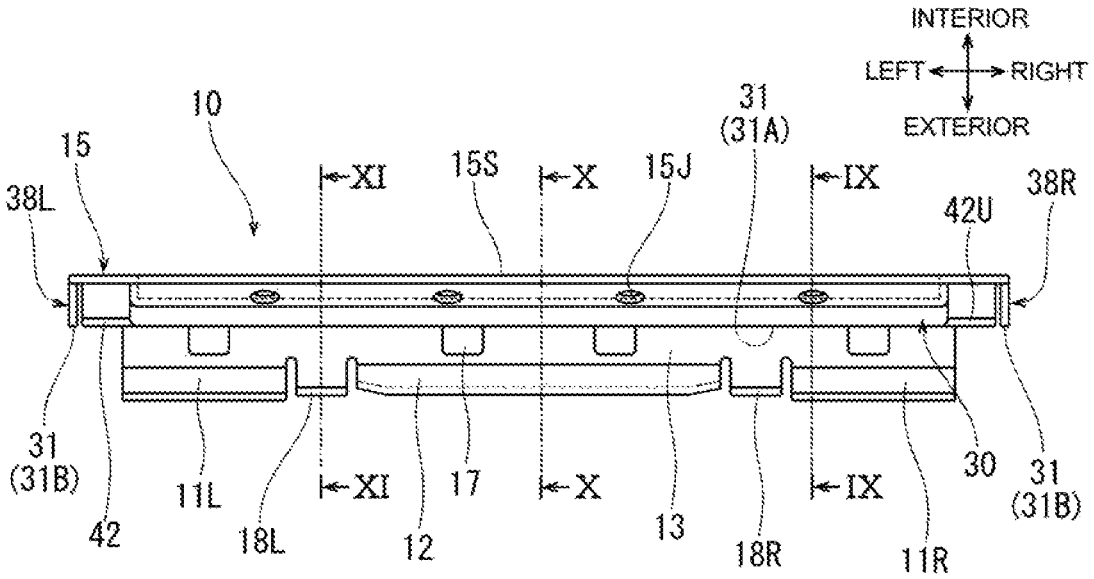
FIG. 7 is a top view of the securing member according to the first embodiment.

A crank portion 43 and the second contact portion 42 are formed in an upper part of the folded portion 40. The crank portion 43 is a portion that is bent toward the front side of the securing member 10 at a position below the supporting portion 13. The second contact portion 42 is a portion that is bent upward from the crank portion 43. The second contact portion 42 extends upward so as to become closer to the supporting portion 13 and extends in the horizontal direction. The front surface of the second contact portion 42 extends parallel to the reference surface 15S. Referring to FIG. 6 and other figures, the width of the second contact portion 42 is greater than the width of the supporting portion 13.

Referring to FIG. 11, in the present embodiment, the distance W1 between an upper end portion 42U of the second contact portion 42 and the lower surface of the supporting portion 13 is in the range of about 0.1 mm to 1 mm. To be specific, the distance W1 is set at a value that allows the upper end portion 42U of the second contact portion 42 to contact the lower surface of the supporting portion 13 when the supporting portion 13 bends downward by supporting the exterior wall plate 2. Thus, the second contact portion 42 of the folded portion 40 reinforces the supporting portion 13. Alternatively, the distance W1 may be zero. In this case, the upper end portion 42U of the second contact portion 42 is located at a position where the upper end portion 42U is in contact with the lower surface of the supporting portion 13.

Referring to FIGS. 6, 8, and other figures, a part of the folded portion 40 extending from the bent portion 41 to the crank portion 43 is adjacent to the peripheral edge portion of the fixing portion 15 while covering a lower part of the opening 15M. Thus, the folded portion 40 reinforces a part of the fixing portion 15 around the opening 15M.

Referring to FIGS. 5 to 8, the left side plate portion 38L is formed by bending the left end portion 15L of the fixing portion 15. The right side plate portion 38R is formed by bending the right end portion 15R of the fixing portion 15. The side plate portions 38L and 38R project toward the front side of the securing member 10 and extend in the vertical direction.

Portions of the front edges of the side plate portions 38L and 38R located above the supporting portion 13 are second surfaces 31B, which extend parallel to the reference surface 15S of the fixing portion 15. The second surfaces 31B are substantially flush with the first surface 31A. The second surfaces 31B and the first surface 31A constitute the first contact portion 31.

Portions of the front edges of the side plate portions 38L and 38R located below the supporting portion 13 may be flush with the front surface of the second contact portion 42. In this case, these portions and the second contact portion 42 contact the back surface 2B of the exterior wall plate 2.

The erected portion 49 is formed in a portion of the securing member 10 located below the second contact portion 42. To be specific, referring to FIG. 12, a substantially C-shaped groove 49C is formed at a position that is slightly to the left from the center of a part of the folded portion 40 extending from the bent portion 41 to the crank portion 43. The erected portion 49, which is shown in FIG. 5 and other figures, is formed by cutting and raising a plate-like portion inside the substantially C-shaped groove 49C toward the front side of the securing member 10. If the second contact portion 42 has a large area in the second direction, the erected portion 49 may be formed by cutting and raising a part of the second contact portion 42.

Referring to FIG. 6, the erected portion 49 is disposed at the center of the securing member 10 in the width direction, that is, on the center line C1.

Figure 2:
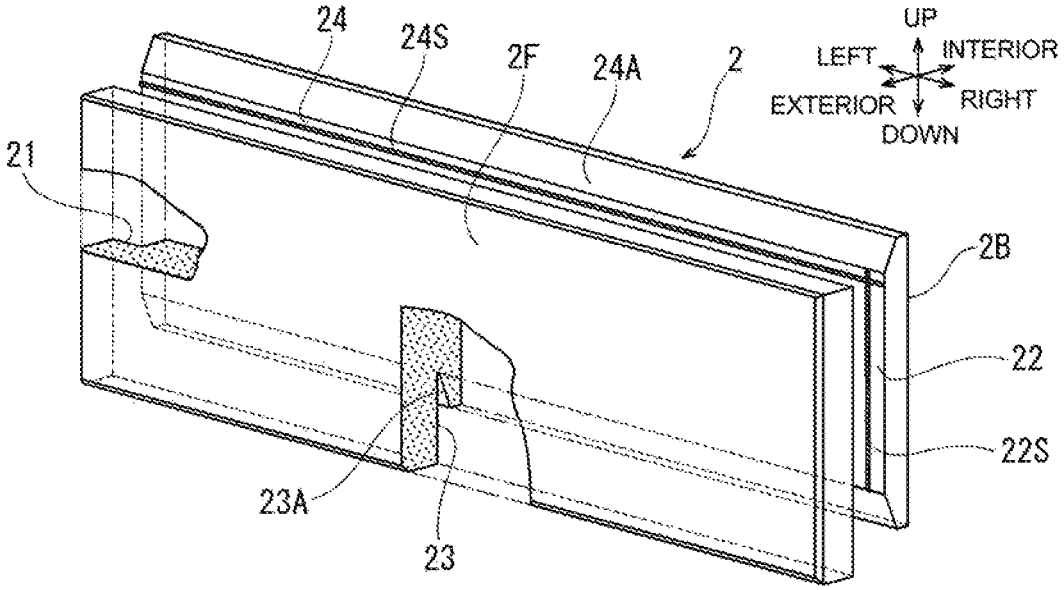
FIG. 2 is a perspective view of an exterior wall plate according to the first embodiment.

Referring to FIGS. 1, 2, 4, and other figures, each exterior wall plate 2 is a quadrangular plate, to be specific, a substantially rectangular plate that is elongated in the horizontal direction. In the present embodiment, the exterior wall plates 2 are made of a ceramic material including cement. The material and shape of the exterior wall plates 2 are not limited to those described above. The material may be selected from metal materials, wood materials, and resin materials as appropriate. The shape may be selected from quadrangular shapes, such as a substantially rectangular plate-like shape that is elongated in the vertical direction, as appropriate.

Figure 15:
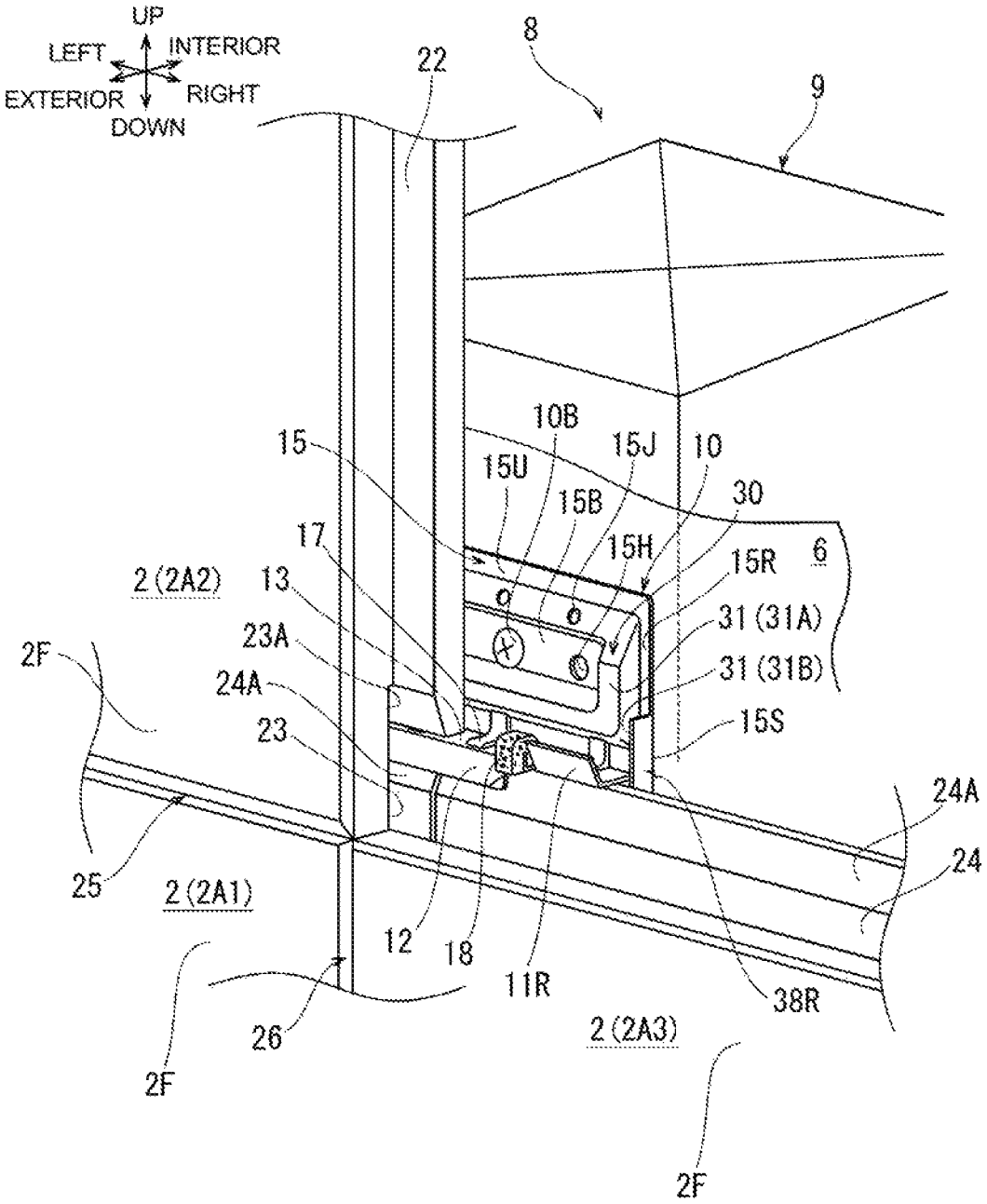
FIG. 15 is a partial perspective view illustrating the structure in which the first to third exterior wall plates are secured by using the securing member according to the first embodiment.
Figure 16:
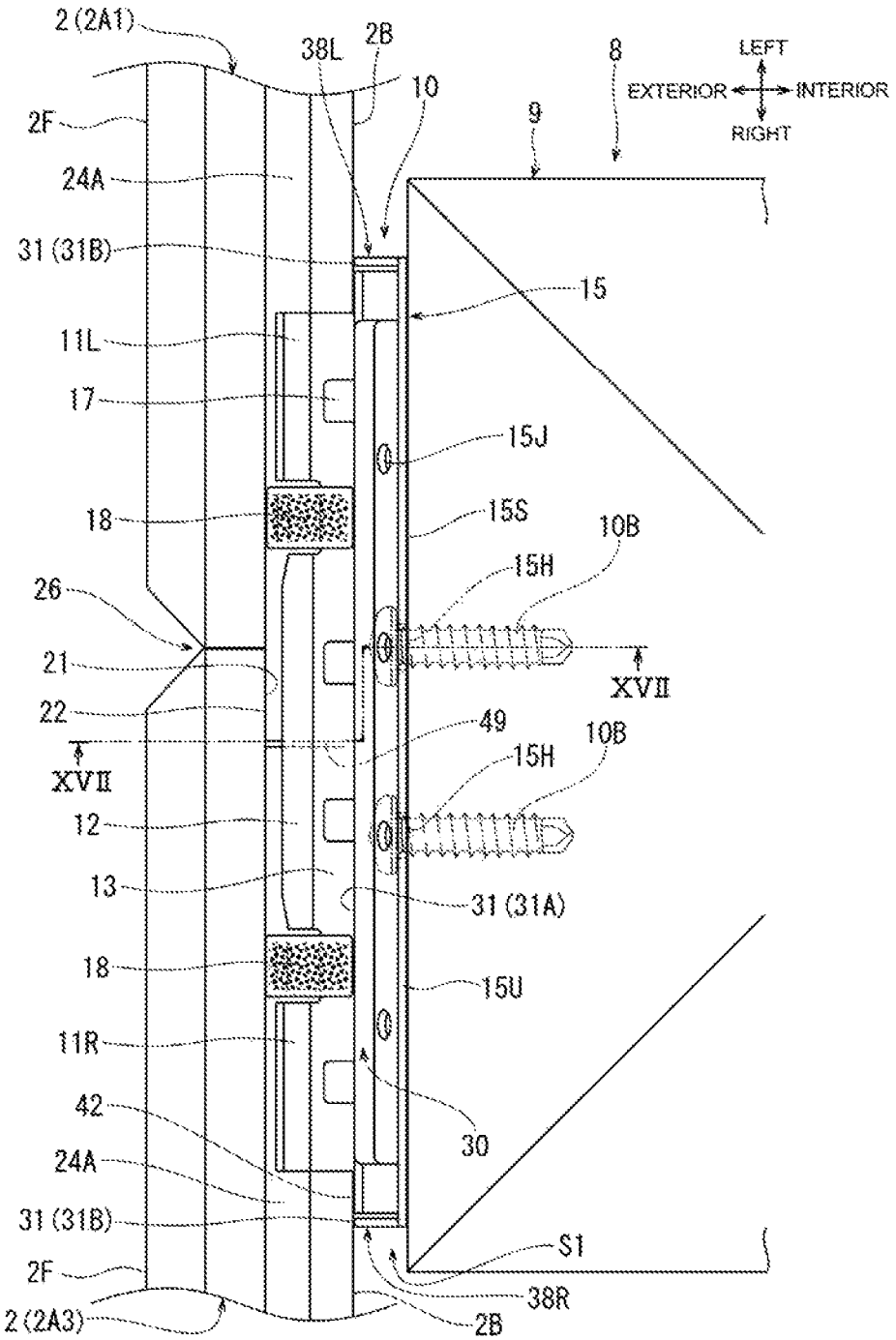
FIG. 16 is a partial sectional view taken along line XVI-XVI in FIG. 14.

Referring to FIGS. 1, 4, 15, and other figures, the exterior wall plates 2 are arranged horizontally and vertically adjacent to each other and are disposed further toward the exterior side of the framework 8 than the waterproof sheet 6 and the support member 7. Thus, the exterior wall plates 2 cover an exterior surface 8F of the framework 8.

Figure 3:
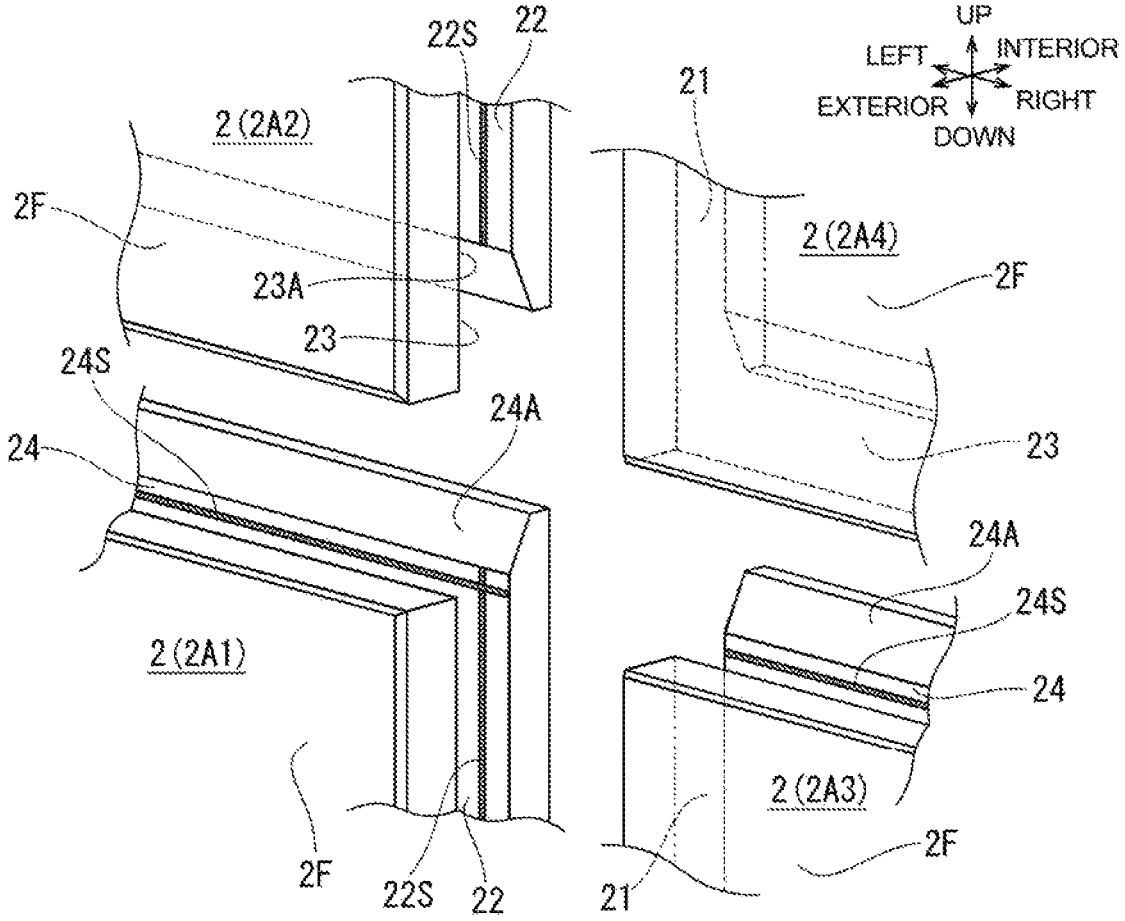
FIG. 3 is a partial perspective view illustrating the structure in which exterior wall plates that are adjacent to each other are assembled in the first embodiment.

Referring to FIGS. 2 and 3, the exterior wall plate 2 has a front surface 2F, which is an exterior surface having, for example, a brick pattern. A left end portion of the exterior wall plate 2 includes a front horizontally joining portion 21. A right end portion of the exterior wall plate 2 includes a back horizontally joining portion 22. A lower end portion of the exterior wall plate 2 includes a front vertically joining portion 23. An upper end portion of the exterior wall plate 2 includes a back vertically joining portion 24.

In FIG. 2, the sizes of the front horizontally joining portion 21, the back horizontally joining portion 22, the front vertically joining portion 23, and the back vertically joining portion 24 are exaggerated relative to the size of the exterior wall plate 2.

The front horizontally joining portion 21 is recessed stepwise from the back surface 2B toward the front surface 2F of the exterior wall plate 2, and extends in the vertical direction, that is, along the left end portion of the exterior wall plate 2.

The back horizontally joining portion 22 is recessed stepwise from the front surface 2F toward the back surface 2B of the exterior wall plate 2, and extends in the vertical direction, that is, along the right end portion of the exterior wall plate 2. A caulking material 22S is disposed on a flat surface of the back horizontally joining portion 22 that faces the exterior side. The caulking material 22S extends linearly along the back horizontally joining portion 22. The caulking material is not essential, and the caulking material 22S of the present embodiment may be omitted.

The front vertically joining portion 23 is recessed stepwise from the back surface 2B toward the front surface 2F of the exterior wall plate 2, and extends in the horizontal direction, that is, along the lower end portion of the exterior wall plate 2. The front vertically joining portion 23 includes an engagement recess 23A that is tapered substantially upward.

The back vertically joining portion 24 is recessed stepwise from the front surface 2F toward the back surface 2B of the exterior wall plate 2, and extends in the horizontal direction, that is, along the upper end portion of the exterior wall plate 2. A caulking material 24S is disposed on a flat surface of the back vertically joining portion 24 that faces the exterior side. The caulking material 24S extends linearly along the back vertically joining portion 24. The caulking material is not essential, and the caulking material 24S of the present embodiment may be omitted. The back vertically joining portion 24 includes an engagement projection 24A that is located above the caulking material 24S and that is tapered substantially upward.

Figure 17:
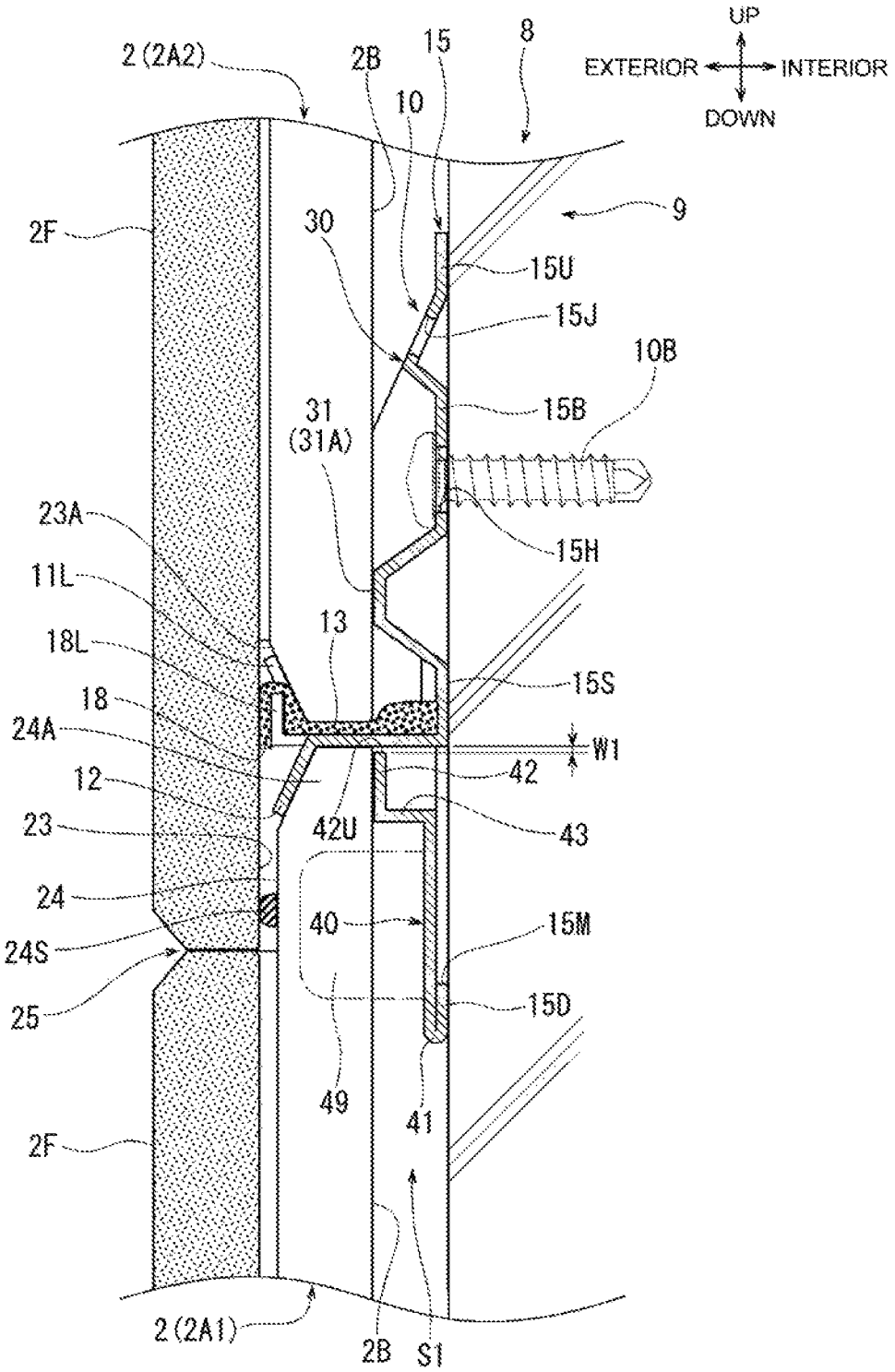
FIG. 17 is a partial sectional view taken along line XVII-XVII in FIG. 16.

Referring to FIGS. 4 and 13 to 16, a first shiplap portion 26 is formed between horizontally adjacent exterior wall plates 2 when the exterior wall plates 2 are placed so that the front horizontally joining portion 21 of one of the exterior wall plates 2 and the back horizontally joining portion 22 of the other exterior wall plate 2 overlap each other. Referring to FIGS. 4, 15, and 17, a second shiplap portion 25 is formed between vertically adjacent exterior wall plates 2 when the exterior wall plates 2 are placed so that the front vertically joining portion 23 of one of the exterior wall plates 2 and the back vertically joining portion 24 of the other exterior wall plate 2 overlap each other.

That is, each exterior wall plate 2 has a so-called "four-side shiplap structure" including the front horizontally joining portion 21, the back horizontally joining portion 22, the front vertically joining portion 23, and the back vertically joining portion 24. The front horizontally joining portion 21 of an exterior wall plate 2 and the back horizontally joining portion 22 of another exterior wall plate 2 overlap each other to form the first shiplap portion 26, and the front vertically joining portion 23 of an exterior wall plate 2 and the back vertically joining portion 24 of another exterior wall plate 2 overlap each other to form the second shiplap portion 25.

Referring to FIG. 4 and other figures, any one of the exterior wall plates 2 is defined as a first exterior wall plate 2A1, and three other exterior wall plates 2 having the following relationships with the first exterior wall plate 2A1 are respectively defined as a second exterior wall plate 2A2, a third exterior wall plate 2A3, and a fourth exterior wall plate 2A4. The second exterior wall plate 2A2 is adjacent to and above the first exterior wall plate 2A1. The third exterior wall plate 2A3 is adjacent to the first exterior wall plate 2A1 at the right side of the first exterior wall plate 2A1. The fourth exterior wall plate 2A4 is adjacent to and above the third exterior wall plate 2A3 and is adjacent to the second exterior wall plate 2A2 at the right side of the second exterior wall plate 2A2.

The exterior wall plates 2 having the above-described structure are supported by the securing members 10 in the following manner.

First, referring to FIG. 1, a plurality of exterior wall plates 2 are attached to the bottom of the exterior surface 8F of the framework 8 so as to be horizontally adjacent to each other. At this time, the lower end portions of the exterior wall plates 2 are engaged with a bottom support member 55 disposed at the bottom of the exterior surface 8F of the framework 8 so as to extend in the horizontal direction. Here, two of the exterior wall plates 2 that are horizontally adjacent to each other will be referred to as the first exterior wall plate 2A1 and the third exterior wall plate 2A3.

Figure 13:
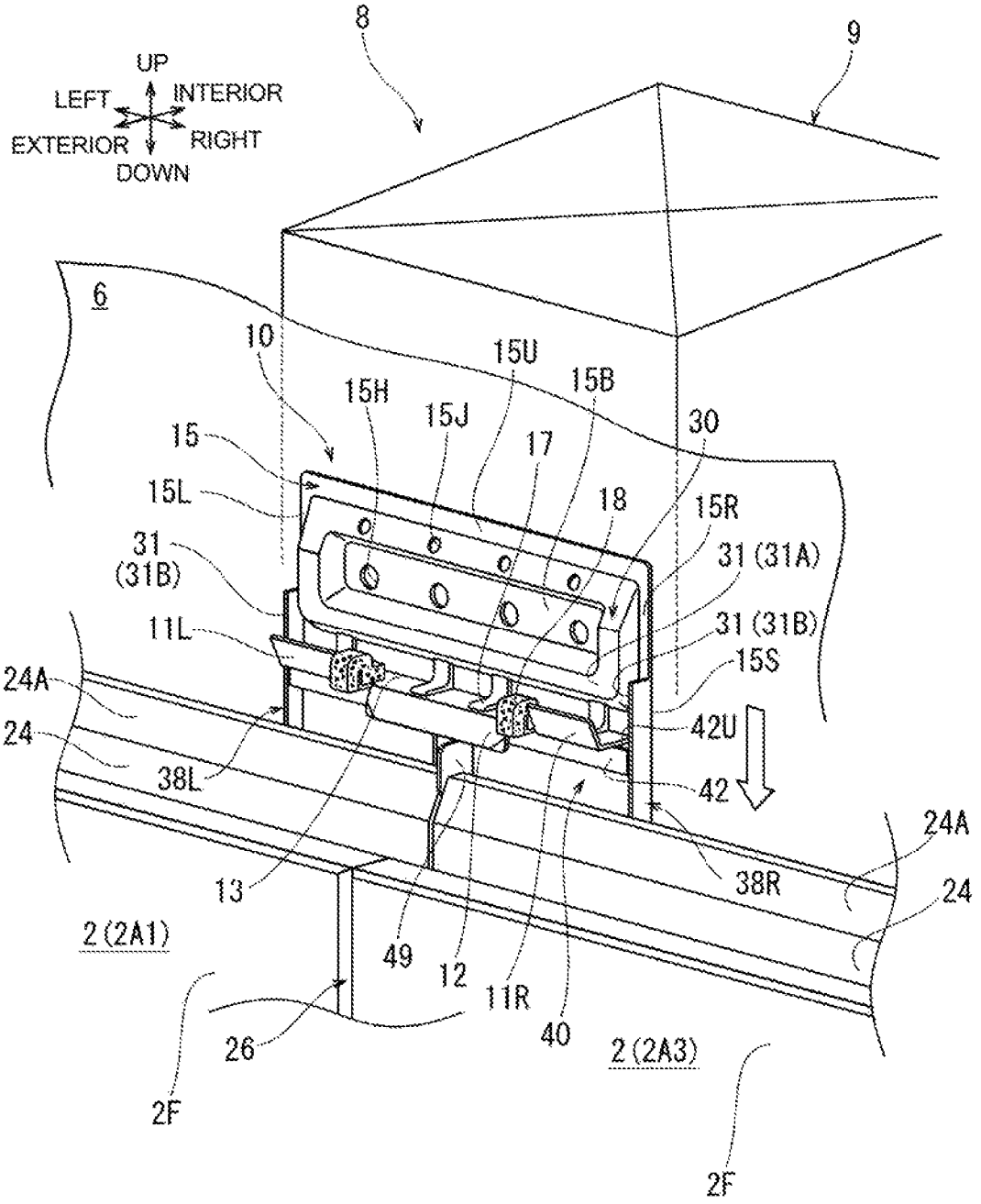
FIG. 13 is a partial perspective view illustrating a method for positioning the securing member and the first and third exterior wall plates according to the first embodiment.

Next, referring to FIG. 13, the securing member 10 is moved downward while the reference surface 15S thereof is in contact with the column 9, and the erected portion 49 of the securing member 10 is inserted into the first shiplap portion 26 of the first and third exterior wall plates 2A1 and 2A3 from above. Then, referring to FIGS. 14 and 16, the screws 10B are inserted through the fixing holes 15H and screwed into the column 9, so that the securing member 10 is fixed to the column 9.

Thus, the engagement projections 24A of the back vertically joining portions 24 of the first and third exterior wall plates 2A1 and 2A3 are retained by the second engagement portion 12 of the securing member 10. In addition, the second contact portion 42 of the securing member 10 contacts the back surfaces 2B of the first and third exterior wall plates 2A1 and 2A3. Thus, the first and third exterior wall plates 2A1 and 2A3 are prevented from being displaced toward the interior side. As a result, referring to FIGS. 16 and 17, a ventilation space S1 is formed between the framework 8 and the back surfaces 2B of the first and third exterior wall plates 2A1 and 2A3.

Thus, the securing member 10 supports the upper end portions of the first and third exterior wall plates 2A1 and 2A3 in the fixed state. In the fixed state, the erected portion 49 of the securing member 10 is disposed between the end portions of the first and third exterior wall plates 2A1 and 2A3 that oppose each other in the horizontal direction, thereby preventing sideways displacement of the first and third exterior wall plates 2A1 and 2A3.

Next, referring to FIGS. 15 and 17, the second and fourth exterior wall plates 2A2 and 2A4 are attached to positions above the first and third exterior wall plates 2A1 and 2A3 so as to be horizontally adjacent to each other.

Thus, the engagement recesses 23A of the front vertically joining portions 23 of the second and fourth exterior wall plates 2A2 and 2A4 are engaged with the first engagement portions 11L and 11R of the securing member 10.

Figure 9:
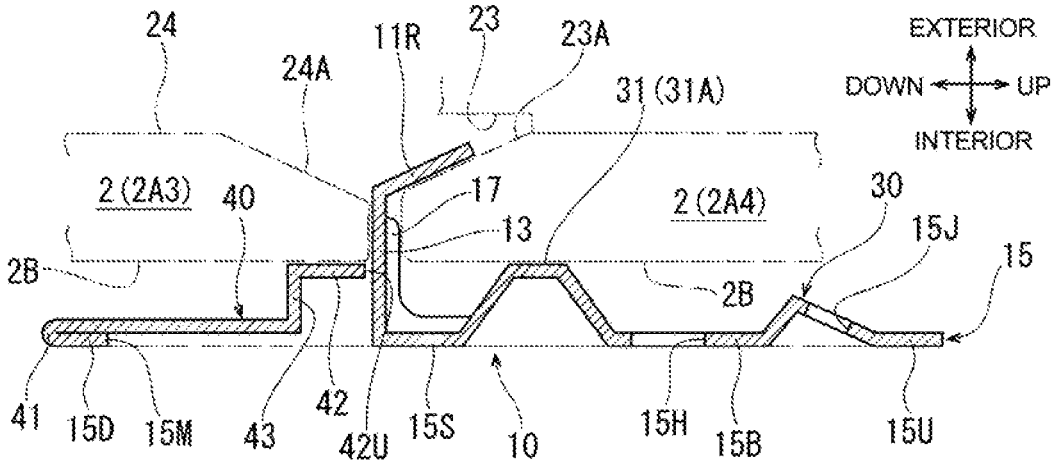
FIG. 9 is a sectional view taken along IX-IX in FIG. 7.
Figure 10:
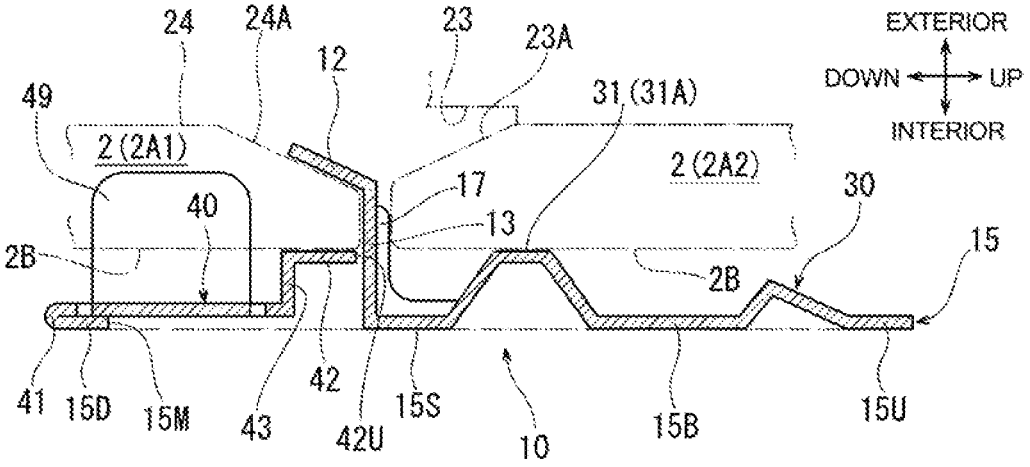
FIG. 10 is a sectional view taken along X-X in FIG. 7.

At this time, referring to FIGS. 9 and 10, the projections 17 on the supporting portion 13 contact lower end portions of the second and fourth exterior wall plates 2A2 and 2A4 from below, and thereby the supporting portion 13 supports the second and fourth exterior wall plates 2A2 and 2A4.

Referring to FIG. 17, one of the elastic members 18 that is adjacent to the left first engagement portion 11L contacts the lower end of the second exterior wall plate 2A2 and becomes compressed and deformed. Although not illustrated, the other elastic member 18 that is adjacent to the right first engagement portion 11R also contacts the lower end of the fourth exterior wall plate 2A4 and becomes compressed and deformed. The elastic members 18 on the left and right sides respectively seal the space between the second exterior wall plate 2A2 and the supporting portion 13 and the space between the fourth exterior wall plate 2A4 and the supporting portion 13.

The first contact portion 31 of the securing member 10, to be specific, the first surface 31A of the bulging portion 30 and the second surfaces 31B of the side plate portions 38L and 38R contact the back surfaces 2B of the second and fourth exterior wall plates 2A2 and 2A4. Thus, the second and fourth exterior wall plates 2A2 and 2A4 are prevented from being displaced toward the interior side. As a result, a ventilation space S1 is also formed between the framework 8 and the back surfaces 2B of the second and fourth exterior wall plates 2A2 and 2A4.

Thus, the securing member 10 supports the second and fourth exterior wall plates 2A2 and 2A4 in the fixed state. Although not illustrated, the upper end portions of the second and fourth exterior wall plates 2A2 and 2A4 are supported on, for example, the column 9 by another securing member 10 in the above-described manner. The above-described operation is performed on other exterior wall plates 2 so that the exterior wall plates 2 are supported on, for example, the columns 9 while being horizontally and vertically adjacent to each other. Thus, the exterior wall plates 2 cover the exterior surface 8F of the framework 8.

Referring to FIG. 4, an additional securing member may be disposed between any two securing members 10 that are arranged horizontally adjacent to each other. In this case, the exterior wall plates 2 that are vertically adjacent to each other can be more securely supported.

Advantageous Effects

Referring to FIGS. 5 to 10 and other figures, in the securing member 10 according to the first embodiment, the supporting portion 13 projects from the fixing portion 15, and the first engagement portions 11L and 11R and the second engagement portion 12 are disposed on the front edge of the supporting portion 13. The second contact portion 42 is formed in the folded portion 40 that is folded toward the supporting portion 13. Therefore, with the securing member 10, compared with a hypothetical case where the second contact portion 42 is formed on the fixing portion 15, the degree of freedom in positioning the second contact portion 42 is increased. As a result, the second contact portion 42 can be easily disposed near the supporting portion 13. As necessary, the second contact portion 42 may be disposed on the center line C1 of the securing member 10.

Referring to FIGS. 5, 6, and other figures, with the securing member 10, the size of the folded portion 40 can also be easily increased. Therefore, the size of the second contact portion 42 can also be increased. Moreover, with the securing member 10, the folded portion 40 can reinforce a region around a part of the fixing portion 15 adjacent to the folded portion 40. To be specific, referring to FIGS. 5, 6, 8, and other figures, a part of the folded portion 40 extending from the bent portion 41 to the crank portion 43 is adjacent to the peripheral edge portion of the fixing portion 15 while covering a lower part of the opening 15M. Thus, the folded portion 40 reinforces a part of the fixing portion 15 around the opening 15M. Therefore, the entirety of the securing member 10 can easily have a sufficient strength.

As a result, the securing member 10 and the exterior structure according to the first embodiment can stably support the exterior wall plate 2 by preventing deformation of the securing member 10 and can reduce trouble of entry of rainwater from a gap between the exterior wall plates 2.

Referring to FIGS. 11 and 17, in the securing member 10, the distance W1 between the upper end portion 42U of the second contact portion 42 and the lower surface of the supporting portion 13 is in the range of about 0.1 mm to 1 mm. Therefore, the upper end portion 42U of the second contact portion 42 is disposed at a position where the upper end portion 42U is capable of contacting the lower surface of the supporting portion 13 when the supporting portion 13 bends downward by supporting the exterior wall plate 2. Alternatively, the distance W1 may be zero, so that the upper end portion 42U of the second contact portion 42 is located at a position where the upper end portion 42U is in contact with the lower surface of the supporting portion 13. Thus, the second contact portion 42 of the folded portion 40 can support the supporting portion 13. As a result, with the securing member 10, it is possible to effectively reduce deformation of the supporting portion 13 due to a load or the like that is generated when the securing member 10 supports the exterior wall plate 2.

Referring to FIG. 5 and other figures, with the securing member 10, the folded portion 40 includes the bent portion 41, which is folded upward from the lower end portion of 15D of the fixing portion 15. Thus, with the securing member 10, compared with a hypothetical case where the folded portion 40 is folded rightward from the left end portion 15L of the fixing portion 15 or the folded portion 40 is folded leftward from the right end portion 15R of the fixing portion 15, a part of the fixing portion 15 surrounding the opening 15M can be easily reinforced and the second contact portion 42 can be easily formed. Moreover, the second contact portion 42 can be easily disposed on the center line C1 of the securing member 10. As a result, the securing member 10 can more stably support the exterior wall plate 2.

Referring to FIG. 5 and other figures, in the securing member 10, the front end surface of the bulging portion 30, which is formed by pressing, forms the first surface 31A of the first contact portion 31. Therefore, the strength of the first surface 31A can be increased, and the strength of the entirety of the securing member 10 can be increased. Moreover, because the first surface 31A can be easily disposed on the center line C1 of the securing member 10, the back surface 2B of the exterior wall plate 2 can be evenly supported, and the securing member 10 can more stably support the exterior wall plate 2.

Referring to FIG. 5 and other figures, in the securing member 10, the pair of side plate portions 38L and 38R, which are formed by bending the left end portion 15L and the right end portion 15R of the fixing portion 15, can reinforce the fixing portion 15. Therefore, the entirety of the securing member 10 can more easily have a sufficient strength. Moreover, because the side plate portions 38L and 38R are disposed on both sides of the fixing portion 15 and cover the end surfaces of the fixing portion 15, the appearance of the securing member 10 is improved.

Referring to FIG. 5 and other figures, in the securing member 10, the second surfaces 31B of the first contact portion 31 are formed at the front edges of the side plate portions 38L and 38R. That is, the second surfaces 31B are formed by using the thicknesses of the side plate portions 38L and 38R, which are steel plates bent from the fixing portion 15, and the second surfaces 31B are used as a part the first contact portion 31. Therefore, the manufacturing process can be simplified.

Referring to FIGS. 5, 13, and 17, in the securing member 10, the erected portion 49, which is formed in the folded portion 40, can prevent displacement of the exterior wall plate 2. Moreover, compared with a hypothetical case where the erected portion 49 is formed on the fixing portion 15, the degree of freedom in positioning the erected portion 49 is increased. Therefore, the erected portion 49 can be easily disposed near the supporting portion 13.

Second Embodiment

Figure 18:
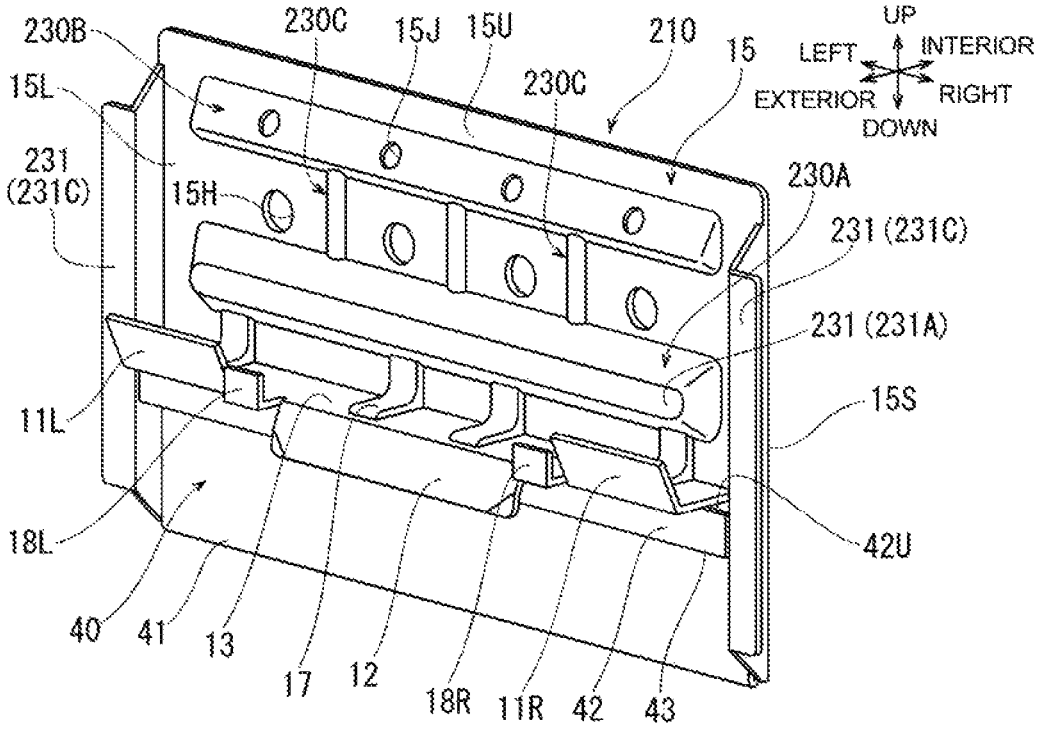
FIG. 18 is a perspective view of a securing member according to a second embodiment.

FIG. 18 illustrates a securing member 210 according to a second embodiment. The securing member 210 includes a bulging portion 230A, a bulging portion 230B, and a plurality of bulging portions 230C, instead of the bulging portion 30 of the securing member 10 according to the first embodiment. In the securing member 210, a front end portion of the left side plate portion 381 is bent leftward, and a front end portion of the right side plate portion 38R is bent rightward. The securing member 210 includes a first contact portion 231, instead of the first contact portion 31 according to the first embodiment. The securing member 210 does not include the erected portion 49 according to the first embodiment. Other elements of the second embodiment are the same as those of the first embodiment. Therefore, elements that are the same as those of the first embodiment will be denoted by the same numerals, and descriptions of such elements will be omitted or simplified.

The bulging portion 230A bulges from the fixing portion 15 toward the front side at a position above the supporting portion 13 and extends in the horizontal direction. The bulging portion 230B bulges from the fixing portion 15 toward the front side at a position above the bulging portion 230A and extends in the horizontal direction. The bulging portions 230C are formed between the bulging portion 230A and the bulging portion 230B. Each bulging portion 230C bulges from the fixing portion 15 toward the front side, extends in the vertical direction, and is connected to the bulging portions 230A and 230B.

A front end surface of the bulging portion 230A is a first surface 231A that extends parallel to the reference surface 15S of the fixing portion 15. The first surface 231A is a part of the first contact portion 231.

Third surfaces 231C, which extend parallel to the reference surface 15S of the fixing portion 15, are formed by a surface of a front end portion of the left side plate portion 38L that is bent leftward and that is located above the supporting portion 13 and a surface of a front end portion of the right side plate portion 38R that is bent rightward and that is located above the supporting portion 13. The third surfaces 231C are substantially flush with the first surface 231A. The third surfaces 231C and the first surface 231A constitute the first contact portion 231.

A front surface of a front end portion of the left side plate portion 38L that is bent leftward and that is located below the supporting portion 13 and a front surface of a front end portion of the right side plate portion 38R that is bent rightward and that is located below the supporting portion 13 may be substantially flush with the front surface of the second contact portion 42 and may contact the back surface 2B of the exterior wall plate 2 together with the second contact portion 42.

The securing member 210 and the exterior structure according to the second embodiment, having the above-described structure, can stably support the exterior wall plate 2 by preventing deformation of the securing member 210 and can reduce trouble of entry of rainwater from a gap between exterior wall plates 2 in the same way as the securing member 10 according to the first embodiment.

Moreover, with the securing member 210, the third surfaces 231C, which are formed by bending the front end portions of the side plate portions 38L and 38R, have a larger area than the second surfaces 31B according to the first embodiment, which are formed by using the thicknesses of the steel plates of the side plate portions 38L and 38R, and the third surfaces 231C can be used as a part of the first contact portion 231. As a result, the first contact portion 231 can more effectively support the back surface 2B of the exterior wall plate 2.

Third Embodiment

Figure 19:
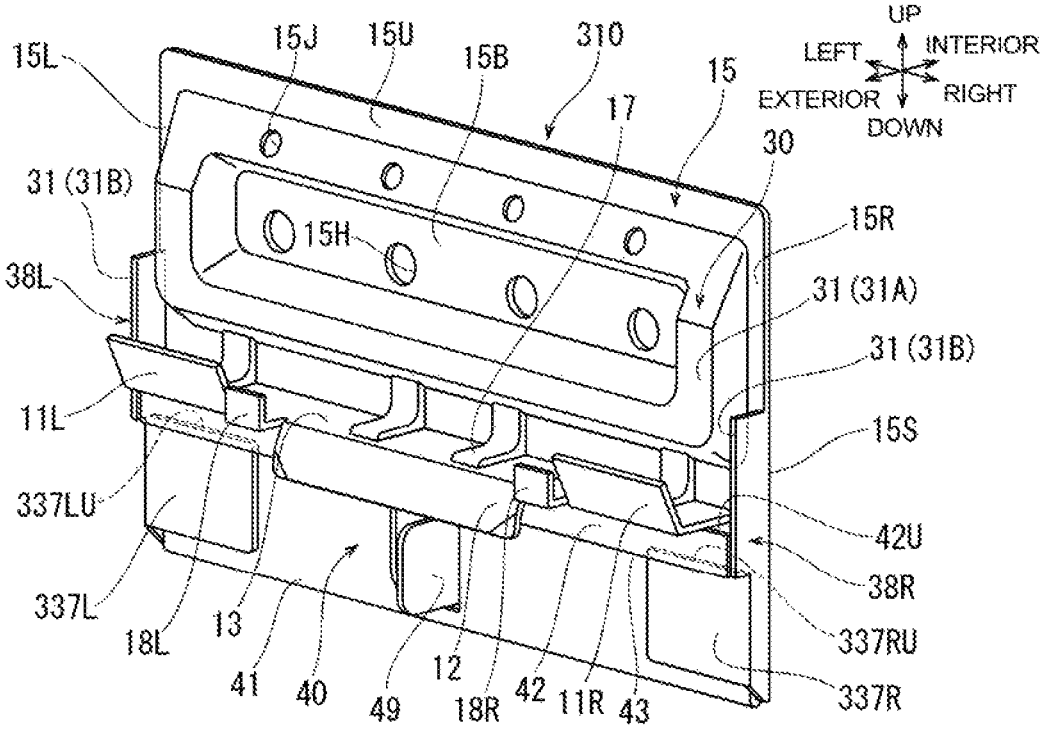
FIG. 19 is a perspective view of a securing member according to a third embodiment.

FIG. 19 illustrates a securing member 310 according to a third embodiment. The securing member 310 includes supporting portions 337L and 337R, which are formed in front end portions of the side plate portions 38L and 38R of the securing member 10 according to the first embodiment. Other elements of the third embodiment are the same as those of the first embodiment. Therefore, elements that are the same as those of the first embodiment will be denoted by the same numerals, and descriptions of such elements will be omitted or simplified.

The supporting portion 337L is formed by bending rightward a front end portion of the left side plate portion 38L located below the second contact portion 42 so as to extend in such a direction that the front end portion supports the second contact portion 42. The supporting portion 337R is formed by bending leftward a front end portion of the right side plate portion 38R located below the second contact portion 42 so as to extend in such a direction that the front end portion supports the second contact portion 42.

An upper end portion 337LU of the left supporting portion 337L and an upper end portion 337RU of the right supporting portion 337R are located at positions where the upper end portions 337LU and 337RU are in contact with the crank portion 43 of the folded portion 40; or the upper end portion 337LU of the left supporting portion 337L and the upper end portion 337RU of the right supporting portion 337R are located at positions, at a distance in the range of about 0.1 mm to 1 mm from the crank portion 43, where the upper end portion 337LU and 337RU are capable of contacting the crank portion 43 when the crank portion 43 bends by supporting the exterior wall plate 2.

The securing member 310 and the exterior structure according to the third embodiment, having the above-described structure, can stably support the exterior wall plate 2 by preventing deformation of the securing member 310 and can reduce trouble of entry of rainwater from a gap between exterior wall plates 2 in the same way as the securing members 10 and 210 according to the first and second embodiments.

Moreover, with the securing member 310, the supporting portions 337L and 337R can support the second contact portion 42 via the crank portion 43 and can reduce deformation of the second contact portion 42. As a result, the second contact portion 42 can more effectively support the back surface 2B of the exterior wall plate 2.

Fourth Embodiment

Figure 20:
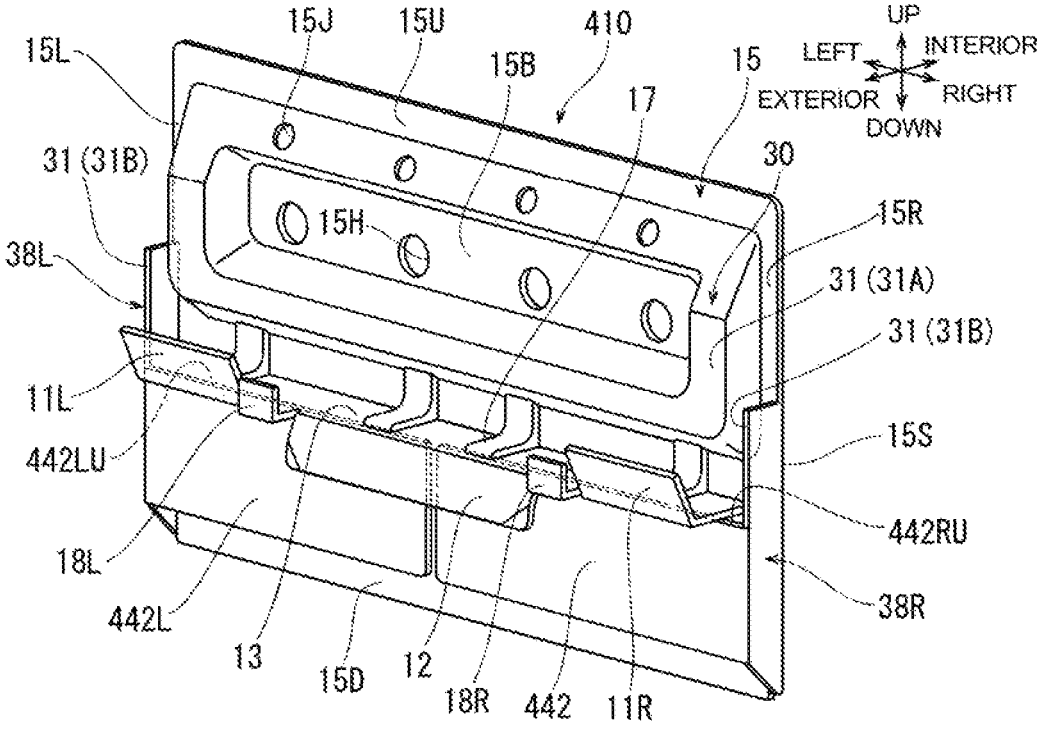
FIG. 20 is a perspective view of a securing member according to a fourth embodiment.

FIG. 20 illustrates a securing member 410 according to a fourth embodiment. The securing member 410 does not include the folded portion 40, the second contact portion 42, and the erected portion 49 of the securing member 10 according to the first embodiment. Instead, the securing member 410 includes second contact portions 442L and 442R that are formed in front end portions of the side plate portions 38L and 38R. Other elements of the fourth embodiment are the same as those of the first embodiment. Therefore, elements that are the same as those of the first embodiment will be denoted by the same numerals, and descriptions of such elements will be omitted or simplified.

The second contact portion 442L is formed by bending rightward a front end portion of the left side plate portion 38L located below the supporting portion 13 so as to extend in such a direction that the front end portion supports the supporting portion 13. The second contact portion 442R is formed by bending leftward a front end portion of the right side plate portion 38R located below the supporting portion 13 so as to extend in such a direction that the front end portion supports the supporting portion 13. A right end portion of the left second contact portion 442L and a left end portion of the right second contact portion 442R oppose each other at the center of the securing member 410 in the width direction. Front surfaces of the second contact portions 442L and 442R extend parallel to the reference surface 15S and are capable of contacting the back surface 2B of the exterior wall plate 2. Although not illustrated, an erected portion 49 may be formed by extending one of opposing end portions of the second contact portions 442L and 442R by a length over which the erected portion 49 is to project and by bending the end portion at a central portion.

An upper end portion 442LU of the left second contact portion 442L and an upper end portion 442RU of the right second contact portion 442R are located at positions where the upper end portions 442LU and 442RU are in contact with the lower surface of the supporting portion 13; or the upper end portion 442LU of the left second contact portion 442L and the upper end portion 442RU of the right second contact portion 442R are located at positions, at a distance in the range of about 0.1 mm to 1 mm from the lower surface of the supporting portion 13, where the upper end portions 442LU and 442RU are capable of contacting the lower surface of the supporting portion 13 when the supporting portion 13 bends by supporting the exterior wall plate 2. Thus, the upper end portions 442LU and 442RU support the supporting portion 13.

The securing member 410 and the exterior structure according to the fourth embodiment, having the above-described structure, can stably support the exterior wall plate 2 by preventing deformation of the securing member 410 and can reduce trouble of entry of rainwater from a gap between exterior wall plates 2 in the same way as the securing members 10, 210, and 310 according to the first to third embodiments.

Fifth Embodiment

Figure 21:
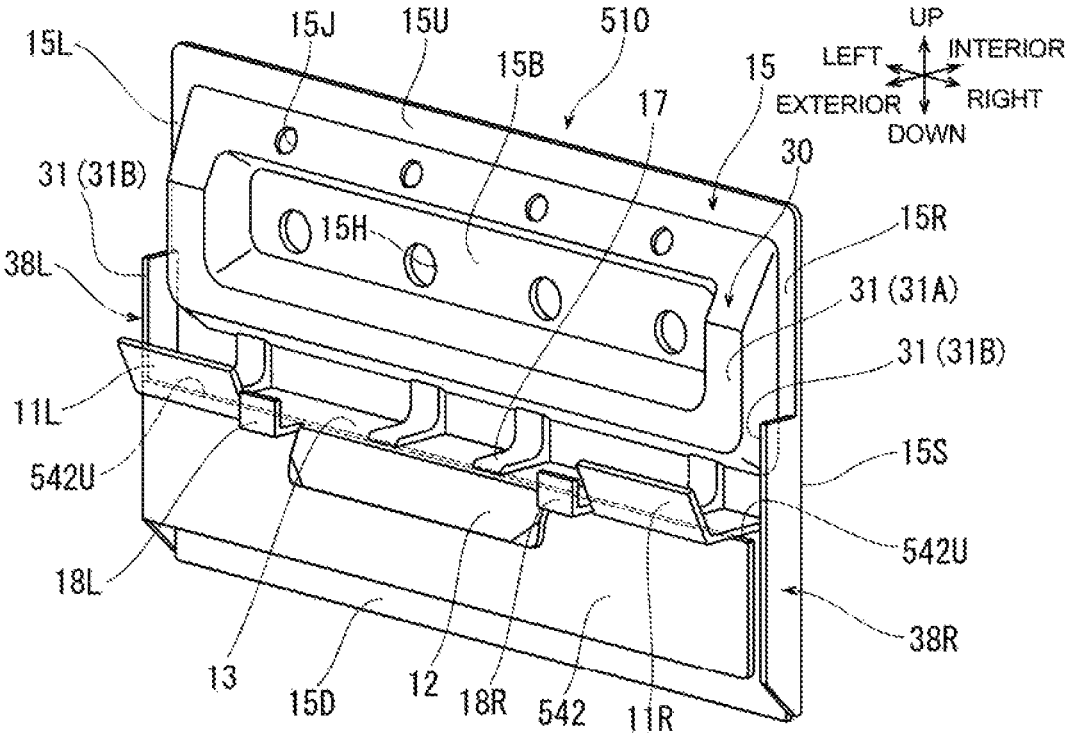
FIG. 21 is a perspective view of a securing member according to a fifth embodiment.

FIG. 21 illustrates a securing member 510 according to a fifth embodiment. The securing member 510 does not include the folded portion 40, the second contact portion 42, and the erected portion 49 of the securing member 10 according to the first embodiment. Instead, the securing member 510 includes a second contact portion 542 that is formed in a front end portion of the left side plate portion 38L. Other elements of the fifth embodiment are the same as those of the first embodiment. Therefore, elements that are the same as those of the first embodiment will be denoted by the same numerals, and descriptions of such elements will be omitted or simplified. Although not illustrated, an erected portion 49 may be formed by cutting and raising a part of the second contact portion 542.

The second contact portion 542 is formed by bending rightward a front end portion of the left side plate portion 38L located below the supporting portion 13 so as to extend toward the supporting portion 13. A right end portion of the second contact portion 542 is located near the right side plate portion 38R. The front surface of the second contact portion 542 extends parallel to the reference surface 15S and is capable of contacting the back surface 2B of the exterior wall plate 2.

An upper end portion 542U of the second contact portion 542 is located at a position where the upper end portion 542U is in contact with the lower surface of the supporting portion 13; or the upper end portion 542U of the second contact portion 542 is located at a position, at a distance in the range of about 0.1 mm to 1 mm from the lower surface of the supporting portion 13, where the upper end portion 542U is capable of contacting the lower surface of the supporting portion 13 when the supporting portion 13 bends by supporting the exterior wall plate 2. Thus, the upper end portion 542U supports the supporting portion 13.

The securing member 510 and the exterior structure according to the fifth embodiment, having the above-described structure, can stably support the exterior wall plate 2 by preventing deformation of the securing member 510 and can reduce trouble of entry of rainwater from a gap between exterior wall plates 2 in the same way as the securing members 10, 210, 310, and 410 according to the first to fourth embodiments.

Sixth Embodiment

In the first to fifth embodiments described above, the supporting portion 13 is integrated with the first engagement portions 11L and 11R and the second engagement portion 12. However, this is not a limitation. Although not illustrated, a part of the supporting portion 13 to which the first engagement portion 11L is connected, a part of the supporting portion 13 to which the second engagement portion 12 is connected, and a part of the supporting portion 13 to which the first engagement portion 11R is connected may be separated from each other. In this case, rainwater on the supporting portion 13 flows downward through gaps between the parts of the supporting portion 13, which are separated from each other and which are connected to the first engagement portions 11L and 11R and the second engagement portion 12. Therefore, the rainwater is prevented from spreading in the width direction along the supporting portion 13.

The present invention is not limited to the first to sixth embodiments described above. The present invention can be applied to any appropriate embodiments within the spirit and scope thereof.

In the first embodiment, the erected portion 49 is formed in a part of the folded portion 40 located below the second contact portion 42. However, this is not a limitation. For example, the erected portion 49 may be formed by cutting and raising a part of the second contact portion 42, or may be formed in the second contact portion 42 and in a portion located below the second contact portion 42.

In the first embodiment, the first direction is the upward direction, the second direction is the downward direction, the first engagement portions 11L and 11R extend upward, and the second engagement portion 12 extends downward. However, this is not a limitation. For example, the first direction may be the downward direction, the second direction may be the upward direction, the first engagement portions may extend downward, and the second engagement portion may extend upward.

What is claimed is:

1. A wall plate securing member for securing a wall plate to a framework of a building, the wall plate securing member comprising:

a fixing portion that is configured to be fixed to the framework;

a supporting portion that projects from the fixing portion and that is configured to support the wall plate;

a first engagement portion that is disposed on the supporting portion and extends in a first direction and that is configured to engage with the wall plate;

a second engagement portion that is disposed on the supporting portion and extends in a second direction, which is opposite to the first direction, and that is configured to engage with the wall plate;

a first contact portion that is disposed in the first direction from the supporting portion and that is configured to contact a back surface of the wall plate; and a second contact portion that is disposed in the second direction from the supporting portion and that is configured to contact the back surface of the wall plate, wherein the second contact portion is formed in a folded portion extending from a substantially 180° bent portion located at a lower end of the fixing portion, and the folded portion is folded toward the supporting portion.

2. The wall plate securing member according to claim 1, wherein an end portion of the second contact portion located in the first direction is disposed at a position where the end portion is in contact with the supporting portion or at a position where the end portion is capable of contacting the supporting portion when the supporting portion bends.

3. The wall plate securing member according to claim 1, further comprising:

a bulging portion that is disposed in the first direction from the supporting portion and bulges from the fixing portion, wherein the first contact portion includes a first surface that is formed by a front end surface of the bulging portion.

4. The wall plate securing member according to claim 1, further comprising:

an erected portion that is formed at a portion located lower than the second contact portion in the second direction and that in use is disposed between opposing end portions of two wall plates that are adjacent to each other.

5. The wall plate securing member according to claim 1, wherein the wall plate is an external wall plate.

6. A wall plate securing member for securing a wall plate to a framework of a building, the wall plate securing member comprising:

a fixing portion that is configured to be fixed to the framework;

a supporting portion that projects from the fixing portion and that is configured to support the wall plate;

a first engagement portion that is disposed on the supporting portion and extends in a first direction and that is configured to engage with the wall plate;

a second engagement portion that is disposed on the supporting portion and extends in a second direction, which is opposite to the first direction, and that is configured to engage with the wall plate;

a first contact portion that is disposed in the first direction from the supporting portion and that is configured to contact a back surface of the wall plate;

a second contact portion that is disposed in the second direction from the supporting portion and that is configured to contact the back surface of the wall plate; and a pair of side plate portions that are respectively formed by bending an end portion of the fixing portion located in a third direction, which is substantially perpendicular to the first direction, and an end portion of the fixing portion located in a fourth direction, which is opposite to the third direction, wherein the second contact portion is formed in a folded portion that is folded toward the supporting portion.

7. The wall plate securing member according to claim 6, wherein the first contact portion includes second surfaces that are formed by front edges of the pair of side plate portions.

8. The wall plate securing member according to claim 6, wherein the first contact portion includes third surfaces that are formed by bending front end portions of the pair of side plate portions in the third direction or in the fourth direction.

9. The wall plate securing member according to claim 6, wherein front end portions of the pair of side plate portions extend in a direction such that the front end portions support the second contact portion at positions in the second direction from the second contact portion.

10. A building exterior structure comprising:

a wall plate;

a framework of a building; and a securing member for securing the wall plate to the framework, wherein the wall plate securing member for securing the wall plate to a framework of a building, the wall plate securing member comprising:

a fixing portion that is configured to be fixed to the framework;

a supporting portion that projects from the fixing portion and that is configured to support the wall plate;

a first engagement portion that is disposed on the supporting portion and extends in a first direction and that is configured to engage with the wall plate;

a second engagement portion that is disposed on the supporting portion and extends in a second direction, which is opposite to the first direction, and that is configured to engage with the wall plate;

a first contact portion that is disposed in the first direction from the supporting portion and that is configured to contact a back surface of the wall plate; and a second contact portion that is disposed in the second direction from the supporting portion and that is configured to contact the back surface of the wall plate, wherein the second contact portion is formed in a folded portion extending from a substantially 180° bent portion located at a lower end of the fixing portion, and the folded portion is folded toward the supporting portion, wherein the fixing portion is fixed to the framework, the supporting portion supports the wall plate, the first engagement portion engages with the wall plate, the second engagement portion engages with the wall plate, the first contact portion contacts a back surface of the wall plate, and the second contact portion contacts the back surface of the wall plate.

11. The building exterior structure according to claim 10, wherein the wall plate is an external wall plate.

* * * * *